US010974885B2

(12) United States Patent
Yamauchi et al.

(10) Patent No.: US 10,974,885 B2
(45) Date of Patent: Apr. 13, 2021

(54) DELAMINATABLE CONTAINER

(71) Applicant: KYORAKU CO., LTD., Kyoto (JP)

(72) Inventors: Yoshio Yamauchi, Tokyo (JP); Teruhisa Hanafusa, Osaka (JP); Kouichiro Yoshida, Tokyo (JP); Yusuke Hiraina, Tokyo (JP)

(73) Assignee: KYORAKU CO., LTD., Kyoto (JP)

( * ) Notice: Subject to any disclaimer, the term of this patent is extended or adjusted under 35 U.S.C. 154(b) by 0 days.

(21) Appl. No.: 16/492,705

(22) PCT Filed: Mar. 14, 2018

(86) PCT No.: PCT/JP2018/009946
§ 371 (c)(1),
(2) Date: Sep. 10, 2019

(87) PCT Pub. No.: WO2018/168922
PCT Pub. Date: Sep. 20, 2018

(65) Prior Publication Data

US 2020/0047966 A1 Feb. 13, 2020

(30) Foreign Application Priority Data

Mar. 15, 2017 (JP) ..... JP2017-050583
Jun. 20, 2017 (JP) ..... JP2017-120323
Jun. 22, 2017 (JP) ..... JP2017-122079

(51) Int. Cl.
*B65D 77/06* (2006.01)
*B65D 1/02* (2006.01)
*B65D 81/38* (2006.01)

(52) U.S. Cl.
CPC ..... *B65D 77/06* (2013.01); *B65D 1/02* (2013.01); *B65D 81/38* (2013.01); *B65D 2231/001* (2013.01)

(58) Field of Classification Search
USPC ..... 222/321.7
See application file for complete search history.

(56) References Cited

U.S. PATENT DOCUMENTS 4,008,830 A * 2/1977 Meshberg ..... B65D 83/0055 222/95
4,162,030 A * 7/1979 Capra ..... B05B 9/0822 222/105

(Continued)

FOREIGN PATENT DOCUMENTS

JP H05-213373 A 8/1993
JP 2003-226374 A 8/2003

(Continued)

OTHER PUBLICATIONS

Extended European search report dated Mar. 5, 2020, in corresponding European patent application No. 18768426.1, 9 pages.

(Continued)

*Primary Examiner* — Michael J. Melaragno
(74) *Attorney, Agent, or Firm* — Maier & Maier, PLLC

(57) ABSTRACT

The delaminatable container is capable of suppressing deterioration of the contents under high-temperature environment. The delaminatable container includes a container body; and a tubular outer case being installed in the container body; wherein: the container body includes an outer shell and an inner bag, and the inner bag shrinks as contents decrease.

15 Claims, 36 Drawing Sheets

(56) References Cited

U.S. PATENT DOCUMENTS 4,469,250 A * 9/1984 Evezich ..... B65D 83/0055 222/83.5
4,894,267 A * 1/1990 Bettle, III ..... B32B 27/28 428/36.7
5,004,123 A * 4/1991 Stoody ..... B05B 11/00412 222/94
5,031,384 A * 7/1991 Rebeyrolle ..... B05B 11/00412 53/452
5,109,892 A * 5/1992 Somers ..... B65B 63/08 141/1
5,242,085 A * 9/1993 Richter ..... B65D 1/0215 215/12.1
5,292,033 A * 3/1994 Gueret ..... B05B 11/3047 222/95
5,320,889 A * 6/1994 Bettle, III ..... B65D 1/0215 215/12.2
5,381,927 A * 1/1995 Richter ..... B65D 1/0215 222/1
5,509,738 A * 4/1996 Haynes ..... F16C 33/201 384/275
5,642,838 A * 7/1997 Stoody ..... B05B 11/0037 222/83
5,954,217 A * 9/1999 Brkovic ..... B65D 3/04 220/62.13
6,039,204 A * 3/2000 Hosokoshiyama ..... B29C 49/4817 220/623
6,042,906 A * 3/2000 Itoh ..... B32B 27/32 428/35.2
6,205,847 B1 * 3/2001 Nomoto ..... B65D 1/0215 73/49.2
6,266,943 B1 * 7/2001 Nomoto ..... B05B 11/3047 53/410
6,276,558 B1 * 8/2001 Kneer ..... B26D 1/44 220/661
6,294,609 B1 * 9/2001 Bertin ..... B32B 27/32 525/57
6,456,903 B1 * 9/2002 Rosenbaum ..... G05D 11/131 137/5
6,467,653 B1 * 10/2002 Hamamoto ..... A45D 19/02 222/105
6,670,007 B1 * 12/2003 Safian ..... B29C 49/22 215/11.3
6,988,496 B1 * 1/2006 Eicher ..... B05B 11/0044 128/200.14
7,802,568 B2 * 9/2010 Eicher ..... A61M 15/0065 128/200.14
7,867,434 B2 * 1/2011 Iwahashi ..... A61F 9/0008 264/513
8,998,020 B2 * 4/2015 Sato ..... B65D 77/0493 220/500
9,067,709 B2 * 6/2015 Furusawa ..... B32B 27/32
10,016,568 B2 * 7/2018 Bach ..... A61M 15/0081
10,202,218 B2 * 2/2019 Eguchi ..... B65D 1/0246
10,213,846 B2 * 2/2019 Aihara ..... B65D 23/02
10,308,389 B2 * 6/2019 Taruno ..... B65D 1/0246
10,377,521 B2 * 8/2019 Taruno ..... B65D 77/225
10,427,821 B2 * 10/2019 Taruno ..... G01M 3/26
10,464,706 B2 * 11/2019 Taruno ..... B65D 23/02
10,494,132 B2 * 12/2019 Uchihashi ..... B65D 83/0055
2001/0027154 A1 * 10/2001 Nomoto ..... B05B 11/00412 493/56
2002/0040908 A1 * 4/2002 Hattori ..... B65D 1/0261 220/678
2002/0130139 A1 * 9/2002 Shiraishi ..... B65D 23/02 222/105
2002/0153386 A1 * 10/2002 Uetake ..... B65D 47/2018 222/1
2004/0076782 A1 * 4/2004 Safian ..... G05D 11/138 428/35.7
2004/0112921 A1 * 6/2004 Nomoto ..... B65D 1/0215 222/321.9
2006/0054635 A1 * 3/2006 Iwahashi ..... B29C 45/1684 222/107
2006/0121228 A1 * 6/2006 Kim ..... C08L 23/06 428/36.9
2007/0292646 A1 * 12/2007 Safian ..... B32B 27/32 428/35.7
2008/0131638 A1 * 6/2008 Hutton ..... B32B 27/306 428/36.6
2009/0174102 A1 * 7/2009 Iwahashi ..... B65D 47/2031 264/40.1
2010/0200586 A1 * 8/2010 Furusawa ..... B65D 23/02 220/62.11
2010/0239799 A1 * 9/2010 Van Hove ..... B65D 23/02 428/35.7
2011/0272417 A1 * 11/2011 Holstine ..... B21D 51/26 220/600
2012/0052225 A1 * 3/2012 Kani ..... C08L 29/04 428/35.4
2012/0104042 A1 * 5/2012 Tirone ..... A23G 9/28 222/105
2013/0129949 A1 * 5/2013 Iwasaki ..... B32B 27/32 428/35.4
2013/0161341 A1 * 6/2013 Kneer ..... B65D 83/62 220/723
2014/0103068 A1 * 4/2014 Son ..... B65D 3/04 222/105
2014/0374439 A1 * 12/2014 Kneer ..... B65D 1/0215 222/1
2015/0041465 A1 * 2/2015 Komatsu ..... B32B 27/306 220/62.11
2015/0210420 A1 * 7/2015 Hosokoshiyama ..... B29C 45/1603 215/12.2
2017/0029156 A1 * 2/2017 Eguchi ..... B65D 1/0246
2017/0029157 A1 * 2/2017 Taruno ..... B65D 23/02
2017/0036802 A1 * 2/2017 Taruno ..... B65D 1/023
2017/0259352 A1 * 9/2017 Aihara ..... B65D 25/16
2017/0313462 A1 * 11/2017 Taruno ..... B65D 83/0055
2018/0016050 A1 * 1/2018 Eguchi ..... B65D 1/0238
2018/0265241 A1 * 9/2018 Taruno ..... B65D 1/0215
2018/0312290 A1 * 11/2018 Uchihashi ..... B32B 27/325
2018/0370673 A1 * 12/2018 Taruno ..... B65D 77/225
2019/0100344 A1 * 4/2019 Taruno ..... F16K 24/06
2019/0232622 A1 * 8/2019 Suzuki ..... B32B 27/08
2019/0241303 A1 * 8/2019 Eguchi ..... B65D 83/0061
2019/0256239 A1 * 8/2019 Taruno ..... B65D 41/0442
2019/0352037 A1 * 11/2019 Taruno ..... B65D 83/0055
2019/0375561 A1 * 12/2019 Taruno ..... B05B 11/047
2020/0062476 A1 * 2/2020 Katayama ..... B65D 47/20
2020/0172312 A1 * 6/2020 Taruno ..... B65D 1/02

FOREIGN PATENT DOCUMENTS

JP 2003-252338 A 9/2003
JP 2003-292073 A 10/2003
JP 2011-073770 A 4/2011
JP 2015-145249 A 8/2015
JP 2015-163531 A 9/2015

OTHER PUBLICATIONS

International Search Report dated Jun. 5, 2018 in corresponding International application No. PCT/JP2018/009946; 1 page.

* cited by examiner

DELAMINATABLE CONTAINER

TECHNICAL FIELD

The present invention relates to a delaminatable container comprising a container body capable of containing contents, the container body being disposed in an outer case.

BACKGROUND

Patent Literature 1 discloses a delaminatable container comprising a container body capable of containing contents, the container body being disposed in an outer case.

CITATION LIST

Patent Literature

[Patent Literature 1] JP 2003-292073A
[Patent Literature 2] JP 2015-163531A

SUMMARY OF THE INVENTION

Technical Problem

Regarding the container body of Patent Literature 1, there are cases where contents that are easily deteriorated under high-temperature environment (for example, cosmetics) are contained in the container body. Accordingly, there is a desire for a delaminatable container which can suppress deterioration of the contents under high-temperature environment.

The present invention has been made by taking the afore-mentioned circumstances into consideration. The present invention provides a delaminatable container which can suppress deterioration of the contents under high-temperature environment.

Solution to Problem

According to the present invention, provided is a delaminatable container, comprising: a container body; and a tubular outer case being installed on the container body; wherein: the container body comprises an outer shell and an inner bag, and the inner bag shrinks as contents decrease.

Regarding the delaminatable container of the present invention, the container body itself is a delaminatable container. Accordingly, the inner bag shrinks as the contents decrease, thereby forming a gap in between the inner bag and the outer shell. Since the heat insulating property is improved by this gap, deterioration of the contents under high-temperature environment can be suppressed.

Hereinafter, various embodiments of the present invention will be described. The embodiments described hereinafter can be combined with each other.

Preferably, the outer case contains the container body therein.

Preferably, each of the container body and the outer case comprises a body portion; and a body portion gap is provided in between a body portion of the container body and a body portion of the outer case.

Preferably, when a thickness of an outer shell of the container body is taken as Ts, and a thickness of the body portion gap is taken as Tg, a formula of $Tg/Ts \geq 0.3$ is satisfied.

Preferably, a formula of $Tg/Ts \geq 0.5$ is satisfied.

Preferably, the container body comprises a body portion and a flanged portion which protrudes from the body portion in a radially outward direction; and the flanged portion is supported by the outer case.

Preferably, the flanged portion comprises an annular portion which protrudes annularly from the body portion in a radially outward direction and a projecting portion which protrudes from the annular portion in a radially outward direction; and the projecting portion is supported by the outer case.

Preferably, the flanged portion is hollow.

Preferably, an outer-air flow passage is provided in between the flanged portion and the outer case.

Preferably, each of the container body and the outer case is provided with a bottom; and a bottom gap is provided in between the bottom of the container body and the bottom of the outer case.

Preferably, the bottom of the container body is provided with an outer-air introducing hole which introduces outer-air in between the outer shell and the inner bag.

Preferably, an inner bag exposed portion which is exposed outside is provided at the bottom side of the inner bag; and the outer-air introducing hole is provided in between the inner bag exposed portion and the outer shell.

Preferably, the contents are filled in the container body; and a gap is provided in between the inner bag and the outer shell in a condition after the contents are filled and before a user starts ejecting the contents.

Preferably, when a volume of the outer shell is taken as Vs, and a volume of contents contained in the inner bag is taken as Vc, a formula of $Vc/Vs \leq 0.95$ is satisfied.

Preferably, the delaminatable container comprises a fixing ring; and the container body and the outer case are installed on the fixing ring.

Preferably, the delaminatable container comprises a pump which ejects the contents; and the pump is installed on the fixing ring.

Preferably, the container body comprises a containing portion which contains contents, and a mouth portion which ejects the contents from the containing portion; the outer case is installed so as to cover at least a portion of the containing portion; and the delaminatable container is constituted so as to be capable of ejecting the contents from the mouth portion by deforming the outer case.

Preferably, the outer case is constituted so as to restore an original shape of the outer case by a restoring ability of the outer case when a pressing force is removed after the outer case is deformed by applying the pressing force to the outer case.

Preferably, the outer case is constituted so that a maximum push-in amount is 5 mm or larger when a pressing force of 2 kg is applied with an indenter having 15 mm diameter.

Preferably, the push-in amount is 10 mm or larger.

Preferably, the outer case is an injection molded body.

Preferably, the outer case comprises a first region and a second region; and the first region is formed with a material having a lower bending elastic modulus than a bending elastic modulus of a material structuring the second region; or the first region is thinner than the second region.

Preferably, the first region is disposed at a position facing a center of the containing portion in a height direction.

Preferably, the outer case is installed so as to cover the container body from the mouth portion side of the container body.

Preferably, the outer case comprises a body member; and the body member is constituted by combining a pair of body constituent members.

Preferably, the outer case comprises a bottom; the body member is disposed at a position closer to the mouth portion than the bottom; and the body member is engaged with the bottom.

Preferably, the container body comprises a bottom which is a bottom of the containing portion; the outer case comprises a body member; the body member comprises a pair of projected portions; and each projected portion of the pair of projected portions face each other, and protrudes towards the bottom of the container body.

Preferably, the projected portion occupies 80% or more of entire width of the body member when the projected portion is observed from a front side.

Preferably, the projected portion has a slope which inclines so that a projection amount of the projected portion increases towards a center with respect to a width direction of the body member, when the projected portion is observed from the front side.

Preferably, the outer case comprises a bottom; the body member is disposed at a position closer to the mouth portion than the bottom; and the body member is not engaged with the bottom at least at the projected portion.

Preferably, the delaminatable container further comprising a cap installed on the mouth portion; and the outer case is clamped and fixed by the cap and the container body.

MODE FOR CARRYING OUT THE INVENTION

Figure 1:
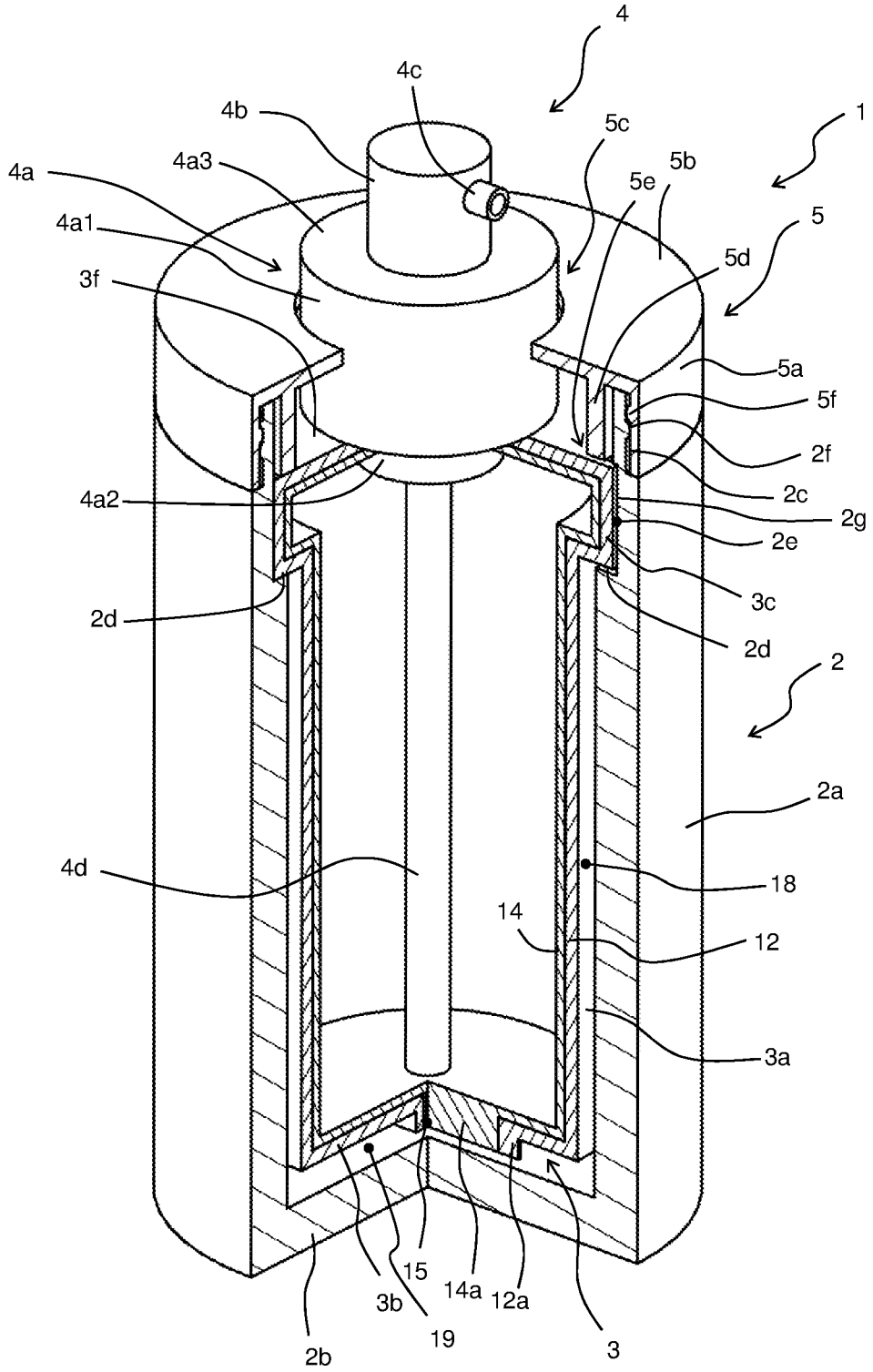
FIG. 1 is a cross sectional perspective view of the delaminatable container 1 according to the first embodiment of the present invention.

Hereinafter, various embodiments of the present invention will be described. Various distinctive features shown in the following embodiments can be combined with each other. In addition, an invention can be established independently for each of the distinctive features.

1. First Embodiment

As shown in FIGS. 1 to 9, the delaminatable container (containing container) 1 according to the first embodiment of the present invention comprises an outer case (outer container) 2, a container body (inner container) 3, a pump 4, and a fixing ring 5. The outer case 2 contains the container body 3 therein.

<Outer Case 2>

The outer case 2 has a bottomed tubular shape, and comprises a body portion 2*a* and a bottom 2*b*. The outer surface side of the upper end of the body portion 2*a* is provided with a reduced diameter portion 2*c* in which the outer surface of the body portion 2*a* is reduced in diameter. The reduced diameter portion 2*c* is provided with a male screw portion 2*f*. A supporting portion 2*d* which supports the flanged portion 3*c* of the container body 3 is provided at the inner surface side near the upper end of the body portion 2*a*. The supporting portion 2*d* is formed by enlarging the diameter of the inner diameter of the body portion 2*a* at the vicinity of the upper end thereof. That is, the upper side of the supporting portion 2*d* is a radially enlarged portion 2*g* in which the inner diameter of the body portion 2*a* is larger than that of the lower side of the supporting portion 2*d*, and a step is formed in the supporting portion 2*d*. The supporting portion 2*d* and the radially enlarged portion 2*g* are provided with an outer-air flow passage 2*e*, and allows the outer-air to flow through the outer-air flow passage 2*e* even when the container body 3 is mounted in the outer case 2. The bottom 2*b* is flat, and the outer case 2 is self-supporting. The manufacturing method and the material of the outer case 2 is not particularly limited, and is preferably a resin molded body formed by injection molding, for example.

<Container Body 3>

The container body 3 is a delaminatable container comprising an outer shell 12 and an inner bag 14, and the inner bag 14 shrinks as the contents decrease. As the contents decrease, the inner bag 14 separates from the outer shell 12, thereby allowing the inner bag 14 to separate from the outer shell 12 and shrink.

The outer shell 12 is made of, for example, low density polyethylene, linear low density polyethylene, high density polyethylene, polypropylene, ethylene-propylene copolymer and mixtures thereof.

The inner bag 14 comprises an EVOH layer provided on the outer surface side of the container, an inner surface layer provided on the inner surface side of the container with respect to the EVOH layer, and an adhesive layer provided in between the EVOH layer and the inner surface layer. By providing the EVOH layer, the gas-barrier property and the delaminating property from the outer shell 12 can be improved. The adhesive layer can be omitted.

The EVOH layer is a layer made of ethylene-vinyl alcohol copolymer (EVOH) resin, and is obtained by hydrolysis of copolymer of ethylene and vinyl acetate. The ethylene content of the EVOH resin is, for example, 25 to 50 mol %, and the ethylene content is preferably 32 mol % or less in view of oxygen-barrier property. The lower limit of the ethylene content is not particularly limited, and is preferably 25 mol % or more since the flexibility of the EVOH layer tends to decrease as the content of ethylene decreases.

The inner surface layer is a layer contacting the contents, and is made of, for example, low density polyethylene, linear low density polyethylene, high density polyethylene, polypropylene, ethylene-propylene copolymer, cycloolefin polymer, EVOH and mixtures thereof, and is preferably made of EVOH. Barrier property can be improved by forming the layer contacting the contents with EVOH.

The adhesive layer is a layer which serves to adhere the EVOH layer with the inner surface layer, and is, for example, an acid modified polyolefin which is an aforementioned polyolefin having a carboxyl group introduced (e.g., maleic anhydride-modified polyethylene), or an ethylene vinyl acetate copolymer (EVA). An example of the adhesive layer is a mixture of low density polyethylene or linear low density polyethylene with acid modified polyethylene.

The container body 3 has a bottomed tubular shape, and comprises a body portion 3*a*, a bottom 3*b*, a flanged portion 3*c*, and a mouth portion 3*d*. The flanged portion 3*c* is provided at the upper end of the body portion 3*a*. The flanged portion 3*c* is provided so as to protrude from the body portion 3*a* in a radially outward direction. The outer diameter of the flanged portion 3*c* substantially matches the radially enlarged portion 2*g*. When the container body 3 is inserted into the outer case 2, the bottom surface of the flanged portion 3*c* comes into contact with the supporting portion 2*d*, and the vertical position of the container body 3 with respect to the outer case 2 is determined. That is, the flanged portion 3*c* is supported by the outer case 2. Further, the circumference surface of the flanged portion 3*c* comes into contact with the inner circumference surface of the radially enlarged portion 2*g*, and thus the horizontal position of the container body 3 with respect to the outer case 2 is determined. When the flanged portion 3*c* comes into contact closely with the radially enlarged portion 2*g* and with the supporting portion 2*d*, it becomes difficult for the outer-air to be introduced into the gap between the outer case 2 and the container body 3. However, in the present embodiment, the outer-air can flow through the outer-air flow passage 2*e*. The flanged portion 3*c* is hollow, and thus the contents can be contained also in the flanged portion 3*c*.

A body portion gap 18 is provided in between the body portion 3*a* of the container body 3 and the body portion 2*a* of the outer case 2. With this gap, the heat insulating property is further improved. When the thickness of the outer shell 12 is taken as Ts, and the thickness of the body portion gap 18 is taken as Tg, it is preferable that formula $Tg/Ts \geq 0.3$ is satisfied, and it is further preferable that formula $Tg/Ts \geq 0.5$ is satisfied. In such case, the heat insulating property can be further improved without increasing the thickness of the outer shell 12. Value of Tg/Ts is, for example, 0.3 to 100, and is specifically for example, 0.3, 0.5, 1, 1.5, 2, 2.5, 3, 3.5, 4, 4.5, 5, 10, 20, 30, 40, 50, 60, 70, 80, 90, or 100, and can be in the range between the two values exemplified herein. When the volume of the container body 3 is taken as V1, and the volume of the outer case 2 is taken as V2, it is preferable that formula $V1/V2 \leq 0.99$ is satisfied, and it is further preferable that formula $V1/V2 \leq 0.90$ is satisfied. Value of V1/V2 is, for example, 0.1 to 0.95, and is specifically for example, 0.1, 0.2, 0.3, 0.4, 0.5, 0.6, 0.7, 0.8, 0.9, 0.95, or 0.99, and can be in the range between the two values exemplified herein.

A bottom gap 19 is provided in between the bottom 3*b* of the container body 3 and the bottom 2*b* of the outer case 2. An inner bag exposed portion 14*a* which is exposed outside is provided at the bottom 3*b* side of the inner bag 14. In the present embodiment, the inner bag exposed portion 14*a* protrudes from the bottom 3*b*, however, the inner bag exposed portion 14*a* need not protrude from the bottom 3*b*. The inner bag exposed portion 14*a* is clamped by the clamping portion 12*a* of the outer shell 12, and an outer-air introducing hole 15 is provided in between the inner bag exposed portion 14*a* and the clamping portion 12*a*. A gap is provided also in between the inner bag exposed portion 14*a* and the bottom 2*b* of the outer case 2 and in between the tip of the clamping portion 12*a* and the bottom 2*b* of the outer case 2. When the inner bag 14 shrinks as the contents are discharged, outer-air is introduced in between the inner bag 14 and the outer shell 12 through the outer-air introducing hole 15. Accordingly, only the inner bag 14 shrinks, and the outer shell 12 retains its original shape, thereby forming a gap in between the inner bag 14 and the outer shell 12. This gap improves the heat insulating property of the delaminatable container, thereby suppressing the deterioration of the contents.

In one example, the container body 3 can be formed by blow molding a tubular laminated parison. The inner bag exposed portion 14*a* and the clamping portion 12*a* can be formed by clamping and crushing the lower end of the laminated parison with a pinch off portion of a split mold. The inner bag exposed portion 14*a* and the clamping portion 12*a* are adhered with each other immediately after the container body 3 is formed, and thus the outer-air introducing hole 15 is not provided. Since the inner bag exposed portion 14*a* and the clamping portion 12*a* are easily delaminated from each other, an impact or a torsional force can be applied so that the inner bag exposed portion 14*a* and the clamping portion 12*a* are delaminated from each other, thereby forming the outer-air introducing hole 15 therebetween.

The container body 3 comprises a mouth portion 3*d*, and a male screw portion 3*e* is provided on the outer surface of the mouth portion 3*d*.

The container body 3 can be covered with a shrink film for decoration. The decoration of the container body 3 can be observed from the outside by using a transparent outer case 2.

<Pump 4>

The pump 4 is configured to discharge the contents from the container body 3 without introducing the outer-air into the container body 3. The pump 4 comprises a main body 4*a*, a piston 4*b*, a nozzle 4*c*, and a tube 4*d*. The main body 4*a* comprises a tubular portion 4*a*1, a cylinder portion 4*a*2, and an upper wall portion 4*a*3. At the inner surface of the tubular portion 4*a*1, a female screw portion 4*a*4 which screws with the male screw portion 3*e* is provided. The cylinder portion 4*a*2 is inserted into the mouth portion 3*d*. The outer diameter of the cylinder portion 4*a*2 substantially matches with the inner diameter of the mouth portion 3*d*. The cylinder portion 4*a*2 has a tubular shape, and the piston 4*b* is capable of sliding within the cylinder portion 4*a*2. The internal space of the cylinder portion 4*a*2 is connected with the nozzle 4*c* and the tube 4*d*. A pump mechanism structured with an elastic member and a valve is provided in the internal space of the cylinder portion 4*a*2. The pump mechanism is operated by sliding the piston 4*b*, thereby allowing the contents suctioned through the tube 4*d* be discharged from the nozzle 4*c*.

<Fixing Ring 5>

The fixing ring 5 comprises an outer tubular portion 5*a*, an upper wall 5*b*, and an inner tubular portion 5*d*. The outer tubular portion 5*a* and the inner tubular portion 5*d* are connected by the upper wall 5*b*. At the inner surface of the outer tubular portion 5*a*, a female screw portion 5*f* which can be screwed with the male screw portion 2*f* is provided. At the upper wall 5*b*, an opening portion 5*c* is provided. The inner diameter of the opening portion 5*c* is larger than the outer diameter of the cylinder 4*a*2. Accordingly, as shown in FIG. 1, a gap is provided in between the outer surface of the tubular portion 4*a*1 of the pump 4 and the inner surface of the opening portion 5*c*, in a condition where the pump 4 is installed onto the mouth portion 3*d*, and the fixing ring 5 is installed onto the outer case 2, thereby allowing air to flow. In addition, when the fixing ring 5 is installed onto the outer case 2 in a condition where the container body 3 is inserted in the outer case 2, the tip of the inner tubular portion 5*d* comes into contact with the upper surface 3*f* of the container body 3, thereby firmly fixing the container body 3 vertically. Here, in the flanged portion 3*c* of the container body 3, the container body 3 fits the outer case 2 by recession/projection. Accordingly, the container body 3 can be fixed with the outer case 2 without the use of the fixing ring 5. When the inner tubular portion 5*d* contacts the upper surface 3*f* closely, it becomes difficult for the outer-air to be introduced into the gap between the outer case 2 and the container body 3. However, in the present embodiment, the outer-air flow passage 5*e* is provided in the inner tubular portion 5*d*, and thus the outer-air can flow through the outer-air flow passage 5*e*.

In the constitution of the present embodiment, the outer-air is introduced into the gap between the inner bag 14 and the outer shell 12 through the opening portion 5*c*, the outer-air flow passages 5*e* and 2*e*, the body portion gap 18, the bottom gap 19, and the outer-air introducing hole 15. Accordingly, even when the delaminatable container 1 is suddenly exposed under high-temperature environment, the hot outer-air hardly contacts the inner bag 14.

<Manufacture and Method of Use>

The delaminatable container 1 of the present embodiment can be manufactured by filling the contents into the container body 3, followed by installment of the pump 4 onto the mouth portion 3*d*, and then inserting such into the outer case 2. In such condition, the fixing ring 5 is installed onto the outer case 2, thereby providing the delaminatable container 1.

Figure 2:
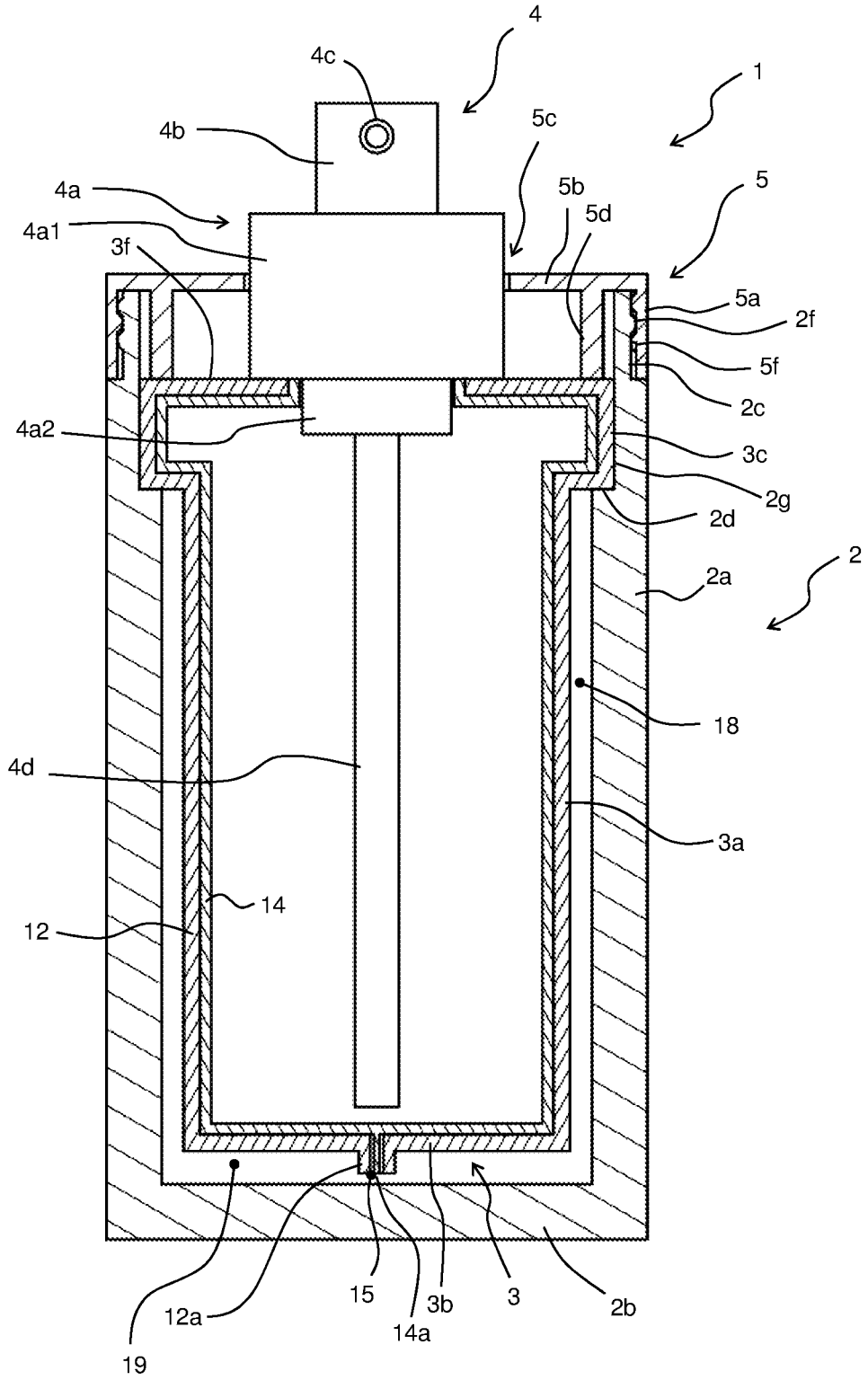
FIG. 2 is a cross sectional view of the delaminatable container 1 of FIG. 1.
Figure 3:
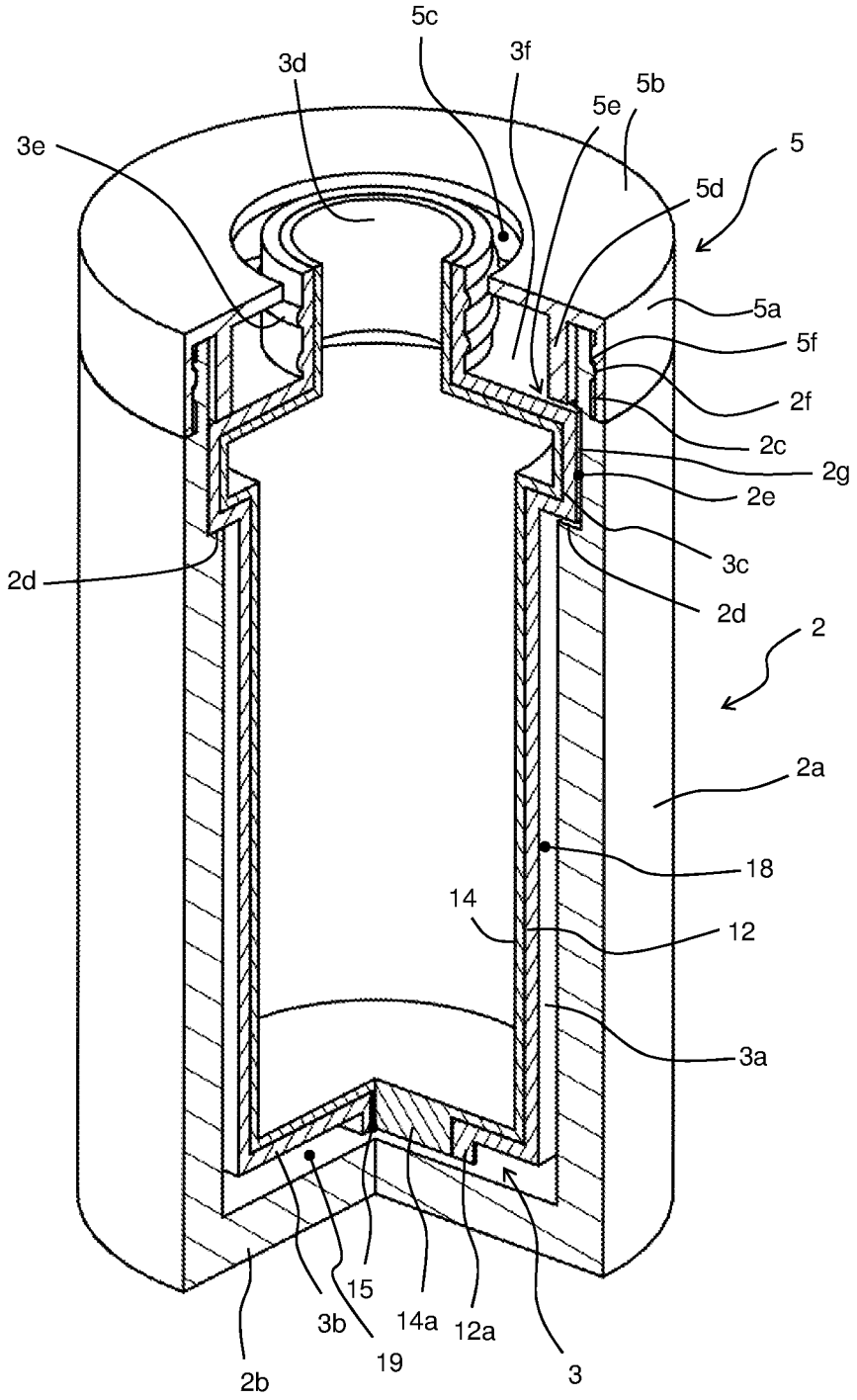
FIG. 3 is a cross sectional perspective view showing a condition in which the pump 4 is removed from FIG. 1.
Figure 4:
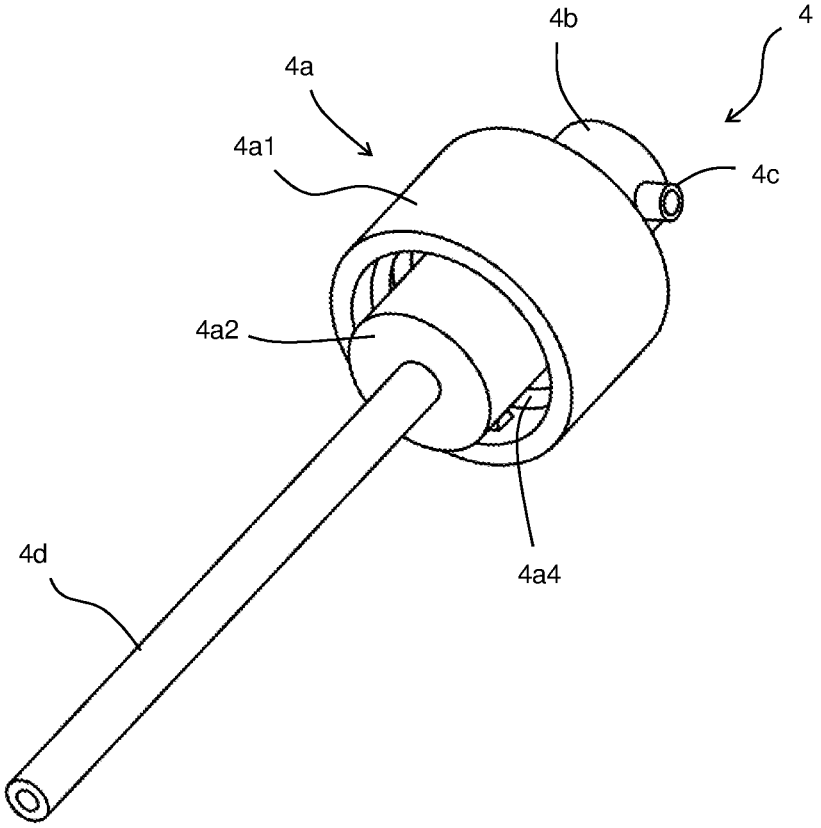
FIG. 4 is a perspective view of the pump 4 of FIG. 1.
Figure 5:
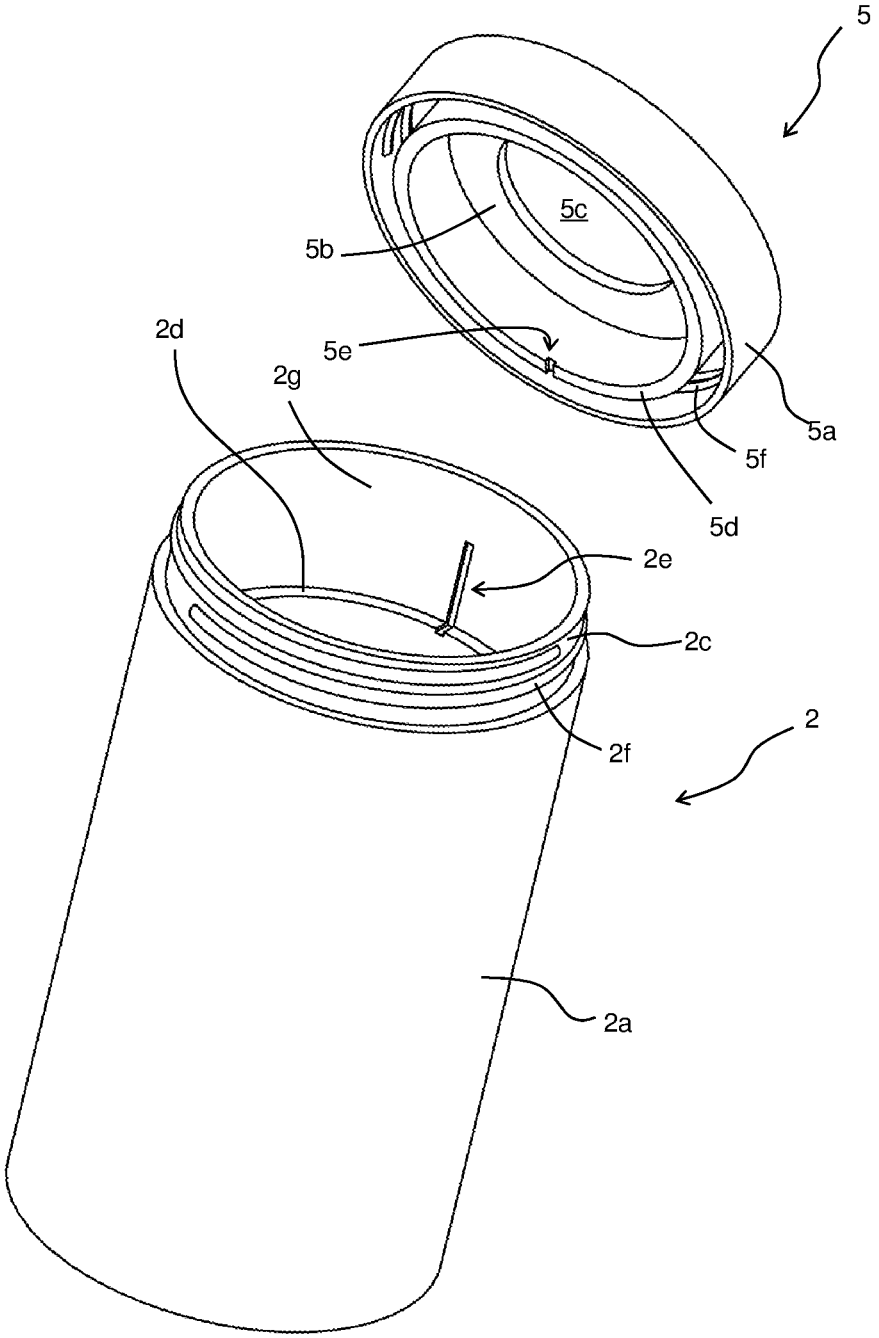
FIG. 5 is a perspective view of the outer case 2 and the fixing ring 5 of FIG. 1.
Figure 6:
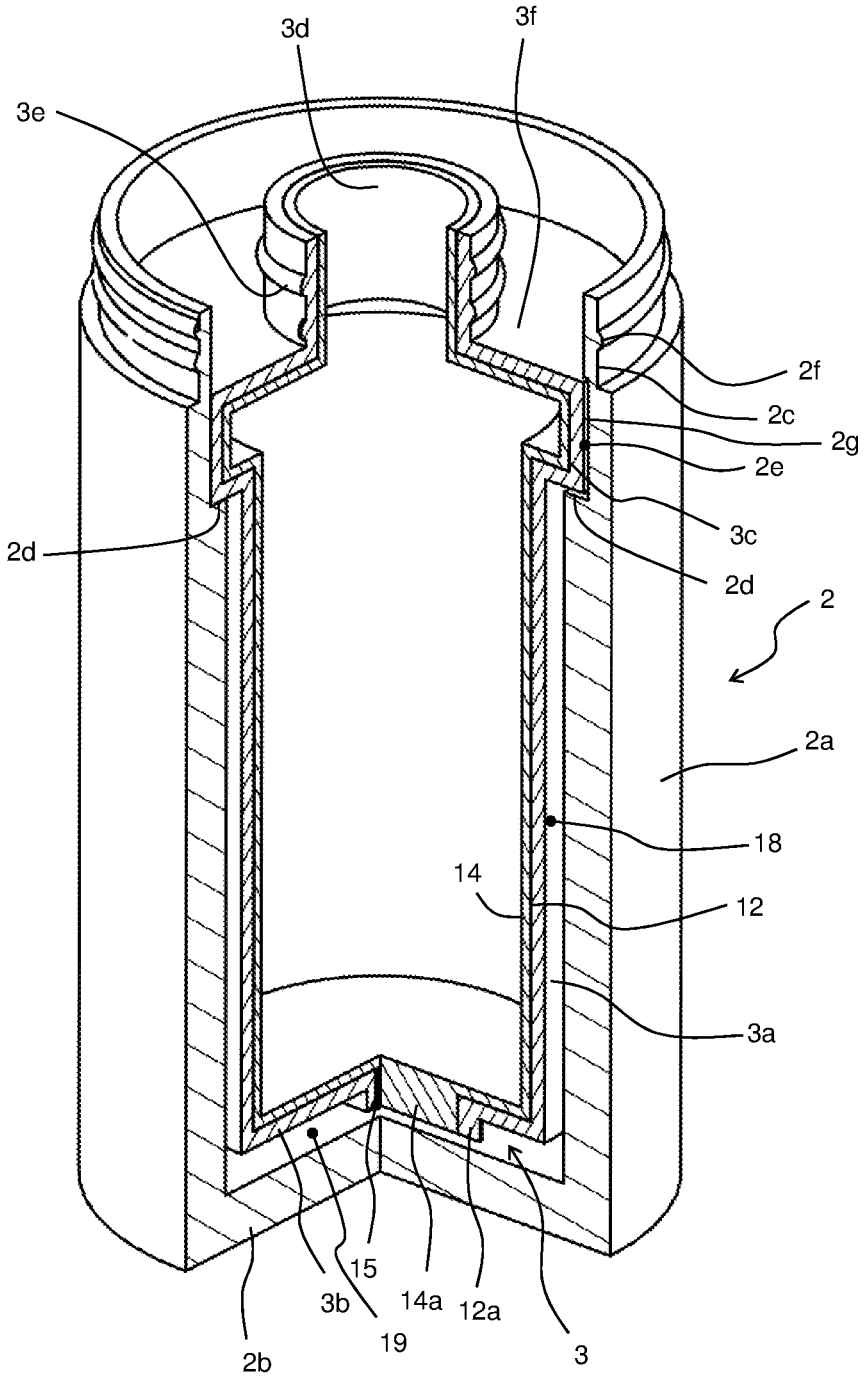
FIG. 6 is a cross sectional perspective view showing a condition in which the fixing ring 5 is removed from FIG. 3.
Figure 7:
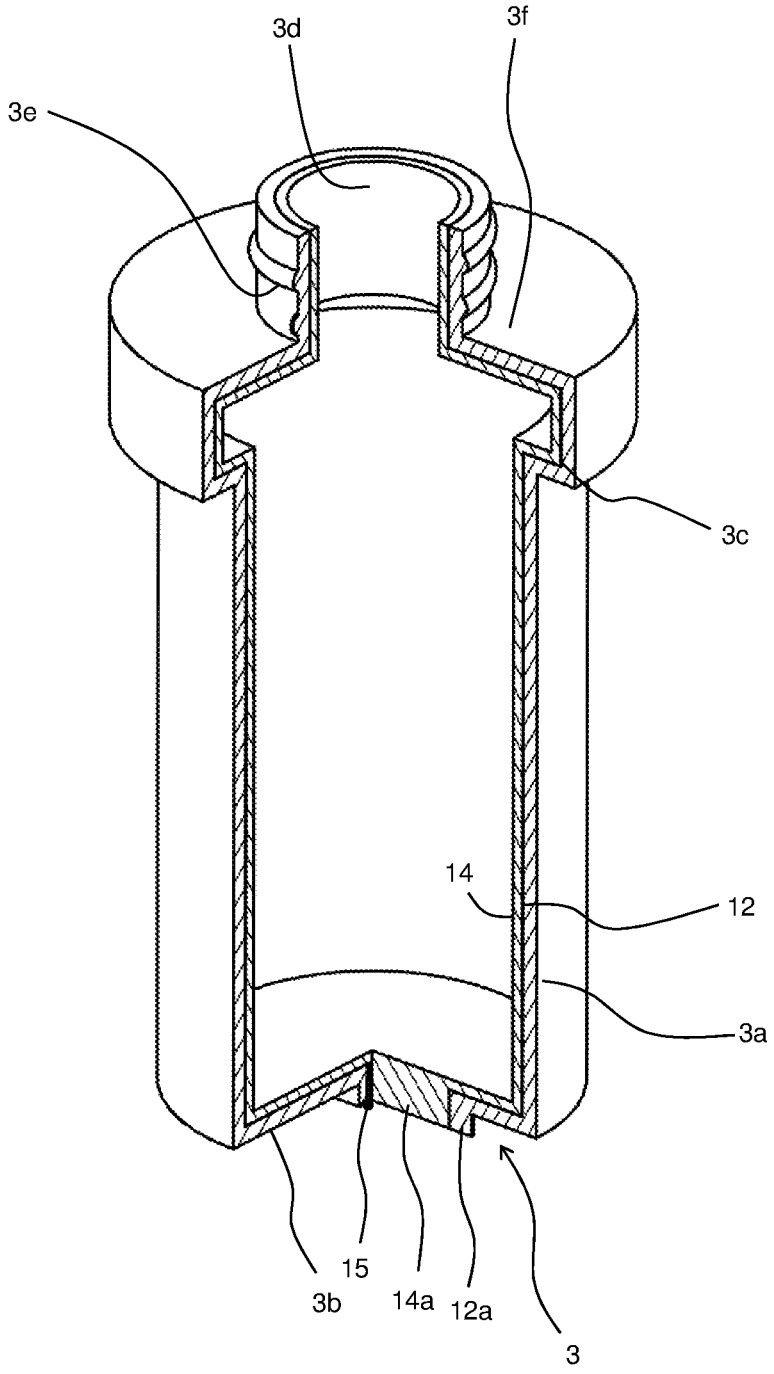
FIG. 7 is a cross sectional perspective view of the container body 3 of FIG. 1.
Figure 8A:
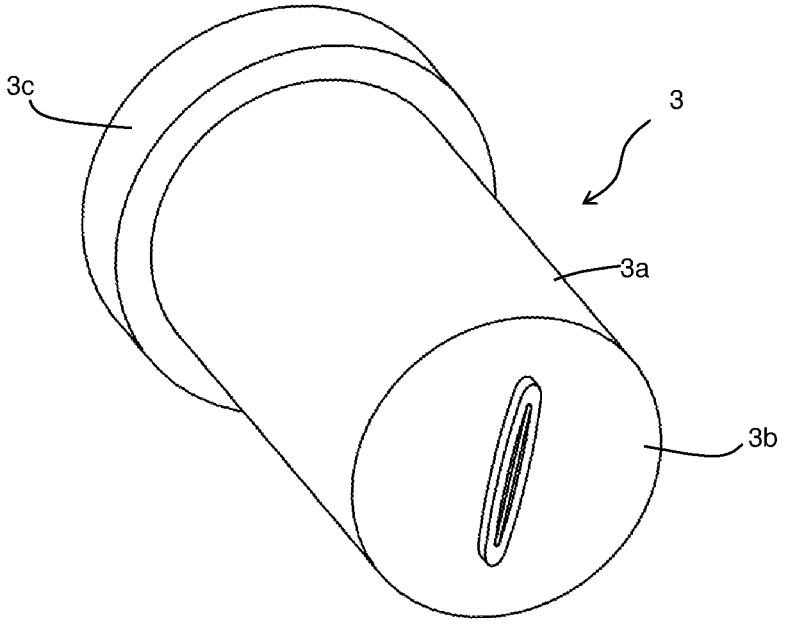
FIG. 8A is a perspective view of the container body 3 observed from the bottom 3*b* side.
Figure 8B:
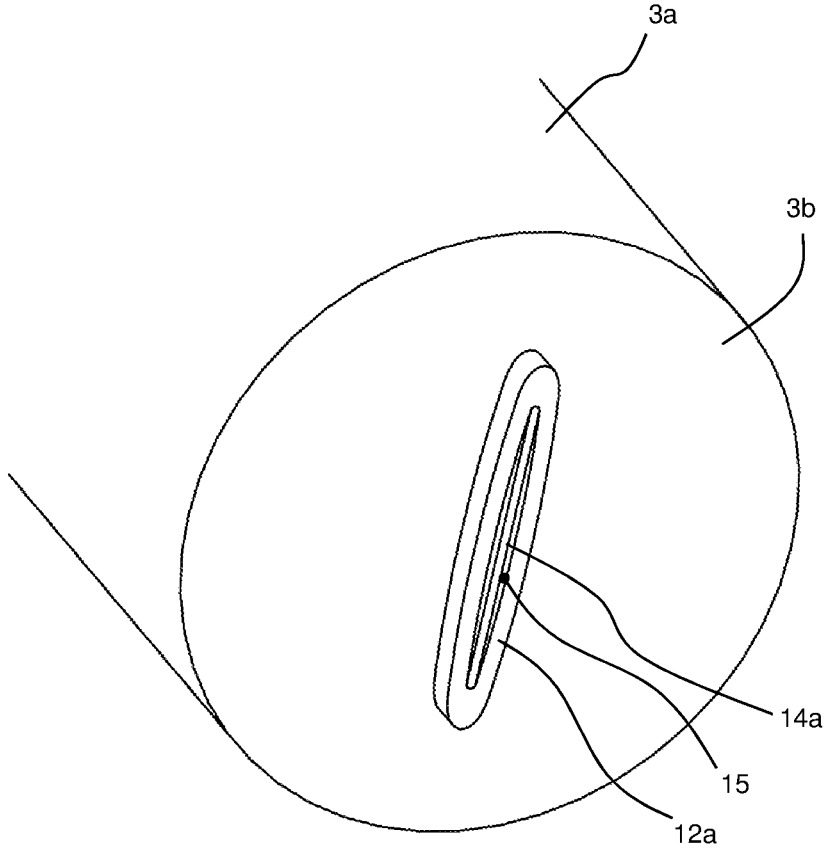
FIG. 8B is an enlarged perspective view of the vicinity of the bottom 3*b*.
Figure 9:
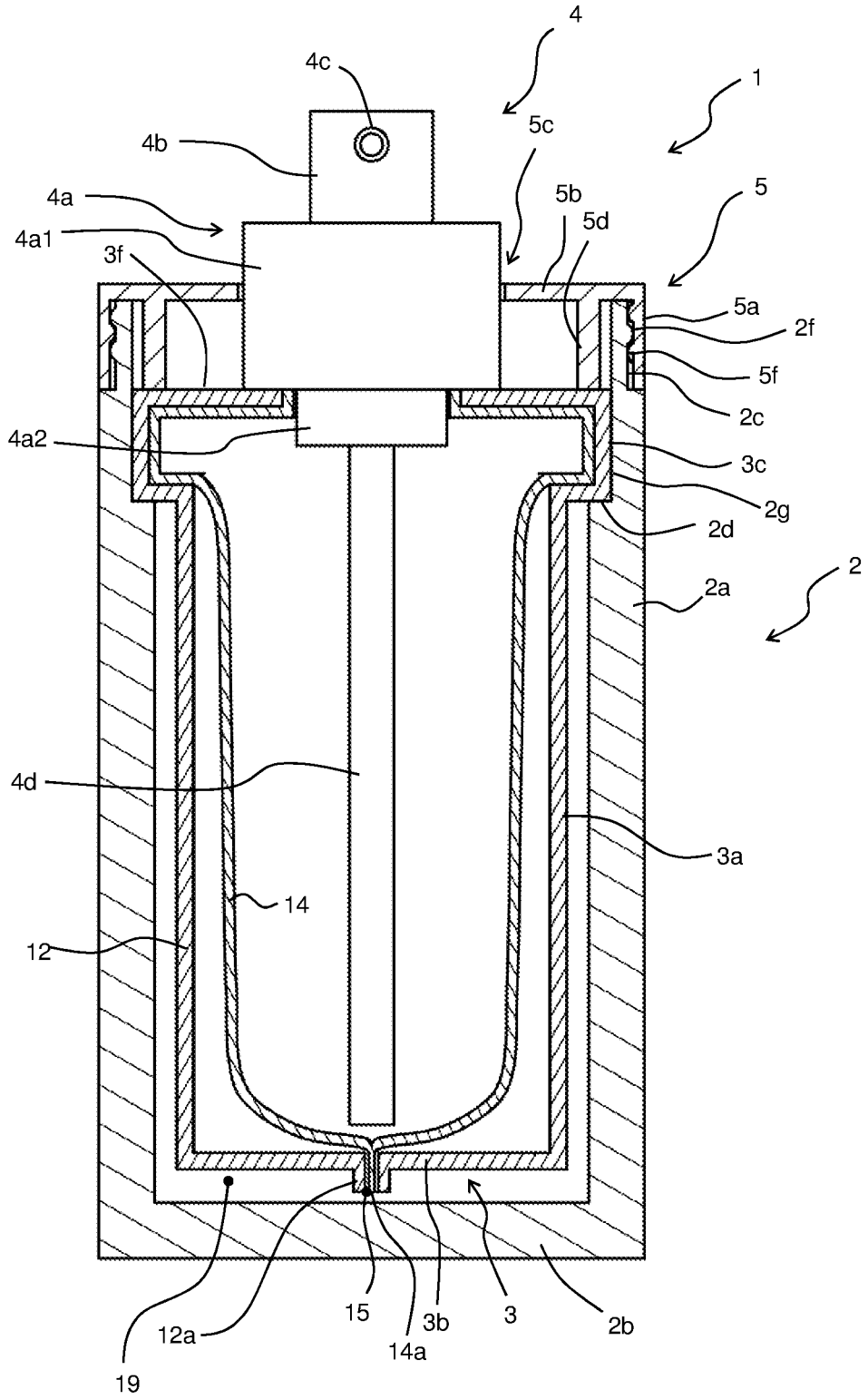
FIG. 9 is a cross sectional view showing a condition in which a gap is provided in between the inner bag 14 and the outer shell 12 of the delaminatable container 1 of FIG. 1.

The contents can be, as shown in FIG. 2, fully filled so as not to provide a gap in between the inner bag 14 and the outer shell 12. Otherwise, as shown in FIG. 9, the contents can be filled so as to provide a gap in between the inner bag 14 and the outer shell 12 (that is, partially filled). In such case, after filling the contents, there is a gap in between the inner bag 14 and the outer shell 12 in a condition before the user starts ejecting the contents. Therefore, heat insulating property is further improved. When the volume of the outer shell 12 is taken as Vs, and the volume of the contents contained in the inner bag is taken as Vc, it is preferable that formula $Vc/Vs \leq 0.95$ is satisfied, and it is further preferable that formula $Vc/Vs \leq 0.9$ is satisfied. Value of Vc/Vs is, for example, 0.5 to 0.95, and is specifically for example, 0.5, 0.55, 0.6, 0.65, 0.7, 0.75, 0.8, 0.85, 0.9, or 0.95, and can be in the range between the two values exemplified herein.

As a method for partially filling the contents, for example, air in the inner bag 14 can be suck out from the mouth portion 3*d*, thereby allowing the inner bag 14 to delaminate from the outer shell 12, as well as allowing the inner bag 14 to shrink, followed by partially filling of the contents, can be mentioned. With such method, the gap can be provided in between the inner bag 14 and the outer shell 12, and the inner bag 14 can be partially filled, while avoiding air to remain in the inner bag 14.

2. Second Embodiment

Figure 10:
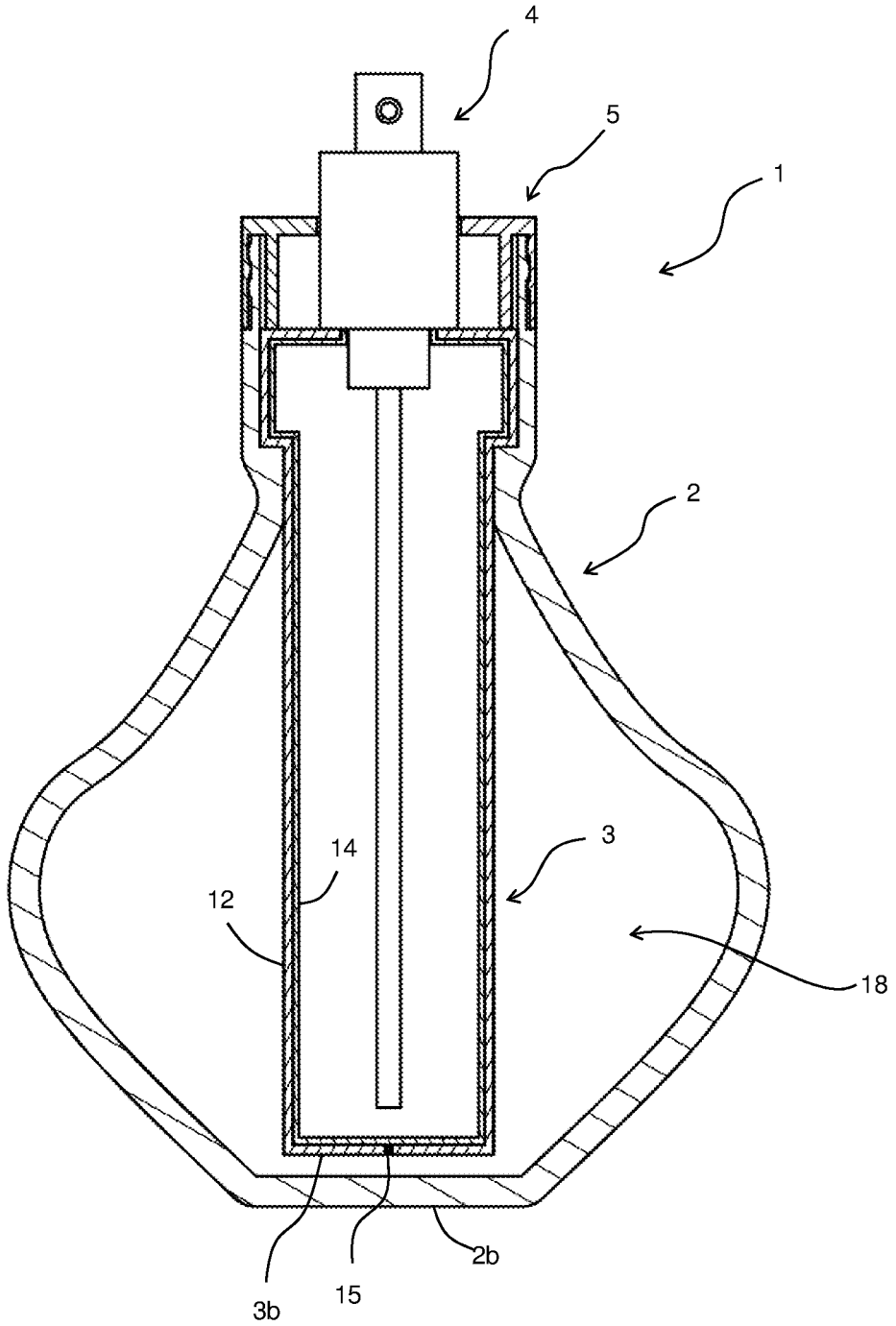
FIG. 10 is a cross sectional view of the delaminatable container 1 according to the second embodiment of the present invention, corresponding to FIG. 2.

The second embodiment of the present invention will be explained with reference to FIG. 10. In the present embodiment, the basic constitution and the function thereof are the same as the first embodiment. The main difference is that the shape of each of the members differ from those of the first embodiment. Hereinafter, such difference will be mainly explained.

In the present embodiment, the outer diameter of the container body 3 is smaller than that of the first embodiment, and the outer case 2 is enlarged in the vicinity of the bottom 2*b*. Accordingly, the body portion gap 18 becomes extremely large, and the heat insulating property is improved. In addition, in the present embodiment, the outer-air is introduced in between the inner bag 14 and the outer shell 12 through the outer-air introducing hole 15 provided at the bottom 3*b*, however, the present embodiment differs from the first embodiment in that the inner bag 14 and the outer shell 12 do not protrude at the bottom 3*b* of the container body 3. Accordingly, the flow of the outer-air in between the bottom 2*b* and the bottom 3*b* is smooth.

3. Third Embodiment

Figure 11:
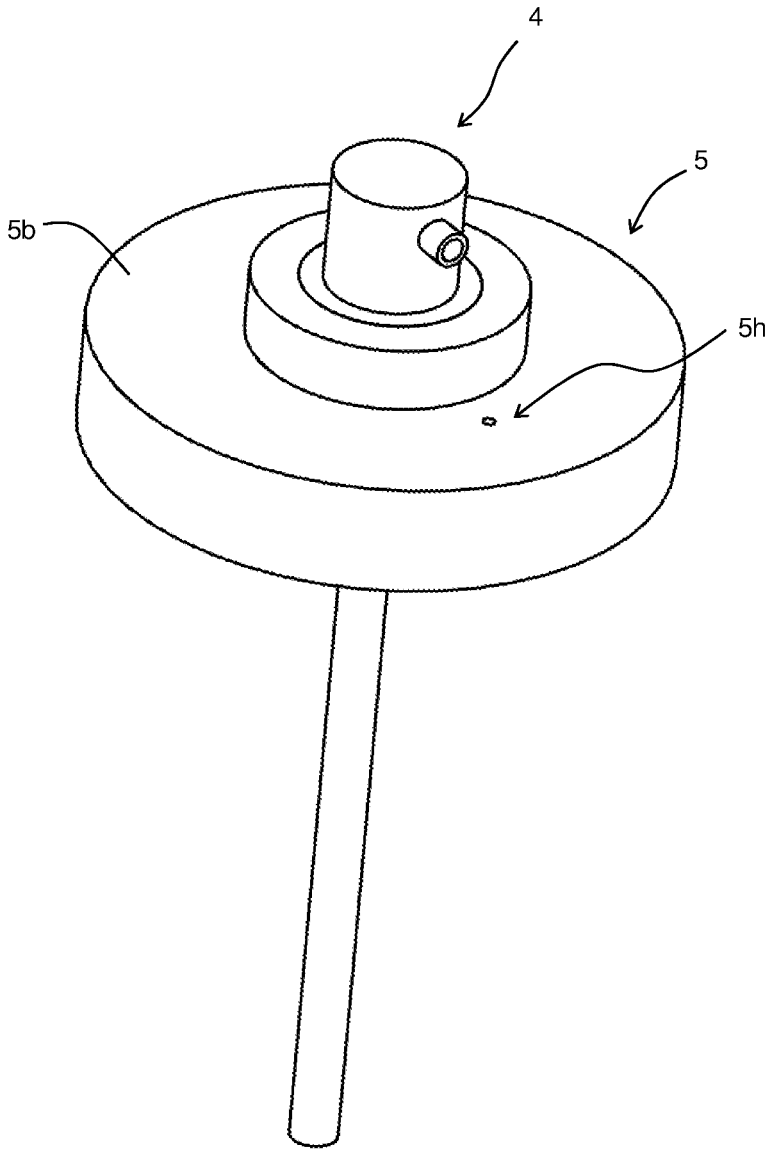
FIG. 11 is a perspective view of the pump 4 and the fixing ring 5 of the delaminatable container 1 according to the third embodiment of the present invention.
Figure 12:
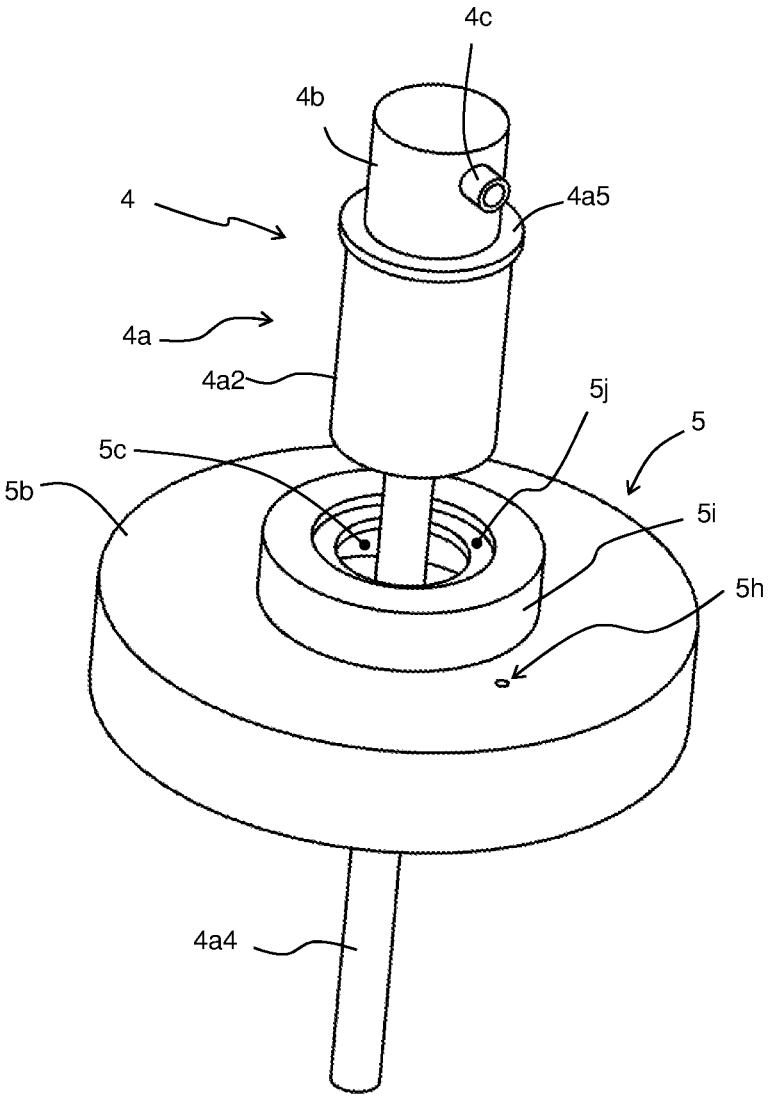
FIG. 12 is a perspective view showing a condition in which the pump 4 is removed from the fixing ring 5 of FIG. 11.
Figure 13:
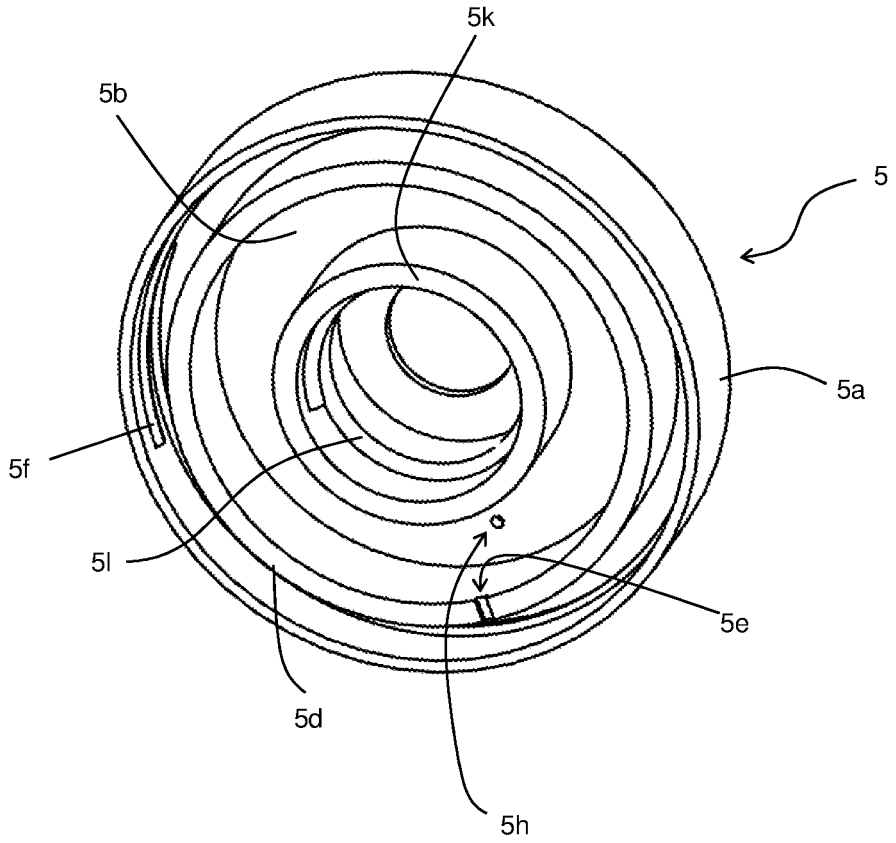
FIG. 13 is a perspective view observed from the lower side of the fixing ring 5 of FIG. 11.

The third embodiment of the present invention will be explained with reference to FIGS. 11 to 13. In the present embodiment, the basic constitution and the function thereof are the same as the first embodiment. The main difference is that the outer case 2 and the container body 3 are installed onto the fixing ring 5, and the pump 4 is also installed onto the fixing ring 5. Hereinafter, such difference will be mainly explained.

In the present embodiment, in addition to the constitution of the first embodiment, the fixing ring 5 is provided with an outer-air introducing hole 5*h*, a projecting portion 5*i*, a recessed portion 5*j*, and a tubular portion 5*k* provided with a female screw portion 5*l*. The pump 4 does not have a tubular portion 4*a*1, and have a flanged portion 4*a*5. The flanged portion 4*a*5 protrudes from the tubular portion 4*a*1 in a radially outward direction.

The outer-air introducing hole 5*h* is provided on the upper wall 5*b*. The projecting portion 5*i* is formed in the center of the upper wall 5*b*. The projecting portion 5*i* can be omitted. The recessed portion 5*j* is formed on the projecting portion 5*i*. The opening portion 5*c* has a size which allows the cylinder 4*a*2 to be inserted through, while not allowing the flanged portion 4*a*5 to be inserted through. The recessed portion 5*j* is structured so as to be engageable with the flanged portion 4*a*5. The tubular portion 5*k* having the female screw portion 5*l* is structured in a similar manner as the tubular portion 4*a*1 having the female screw portion 4*a*4 of the first embodiment.

With such constitution, both of the container body 3 and the outer case 2 can be installed (fastened by screw) onto the fixing ring 5. The pump 4 is also installed onto the fixing ring 5. The pump 4 can be separable from the fixing ring 5, or can be formed uniformly with the fixing ring 5.

In the first embodiment, the outer-air was intended to be introduced into the outer case 2 from the gap between the pump 4 and the fixing ring 5. In the present embodiment, the outer-air is introduced into the outer case 2 from the pinhole-like outer-air introducing hole 5*h*. The outer-air introducing hole 5*h* can be provided in a different place.

4. Fourth Embodiment

Figure 14:
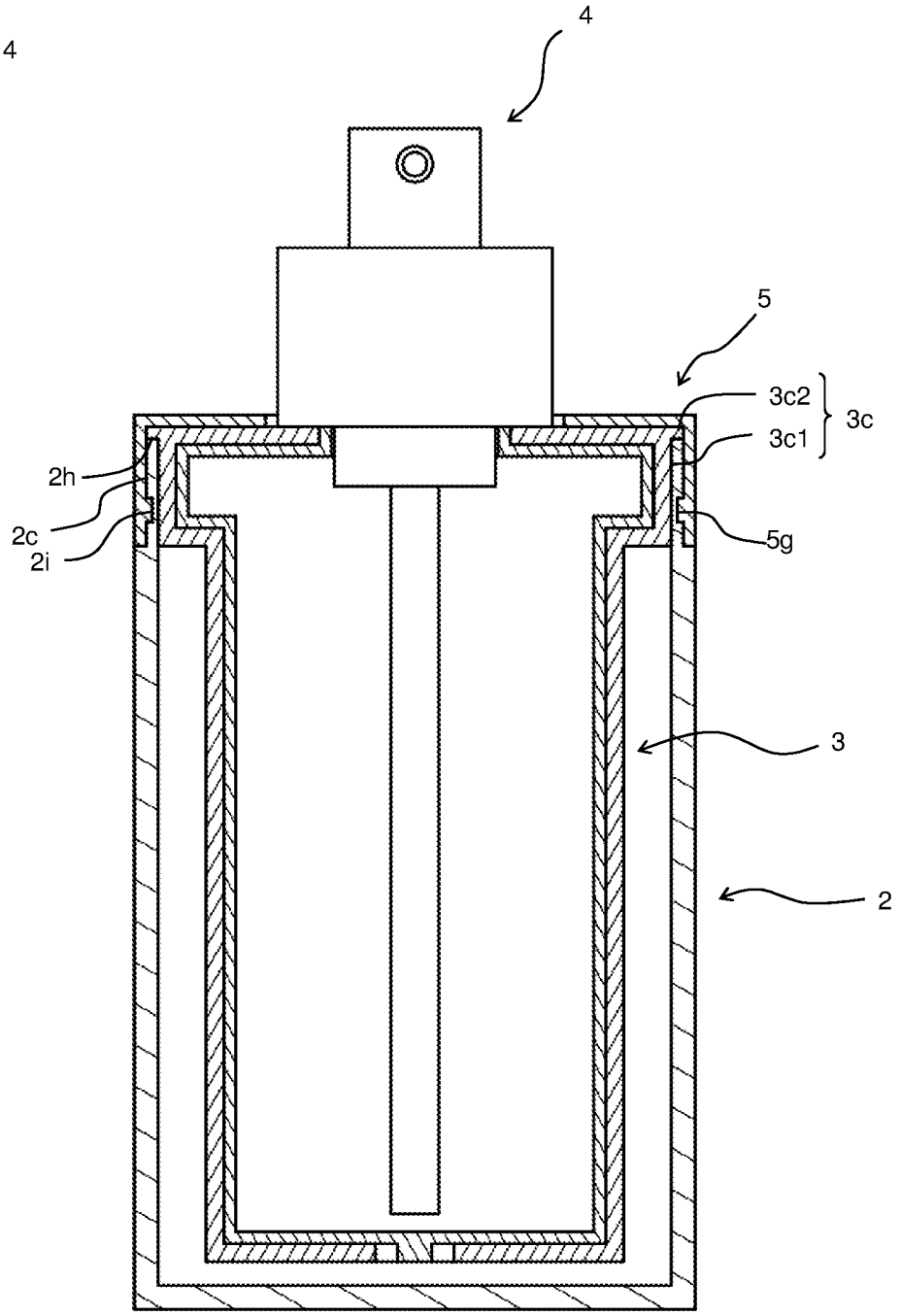
FIG. 14 is a cross sectional view of the delaminatable container 1 according to the fourth embodiment of the present invention, corresponding to FIG. 2.
Figure 15:
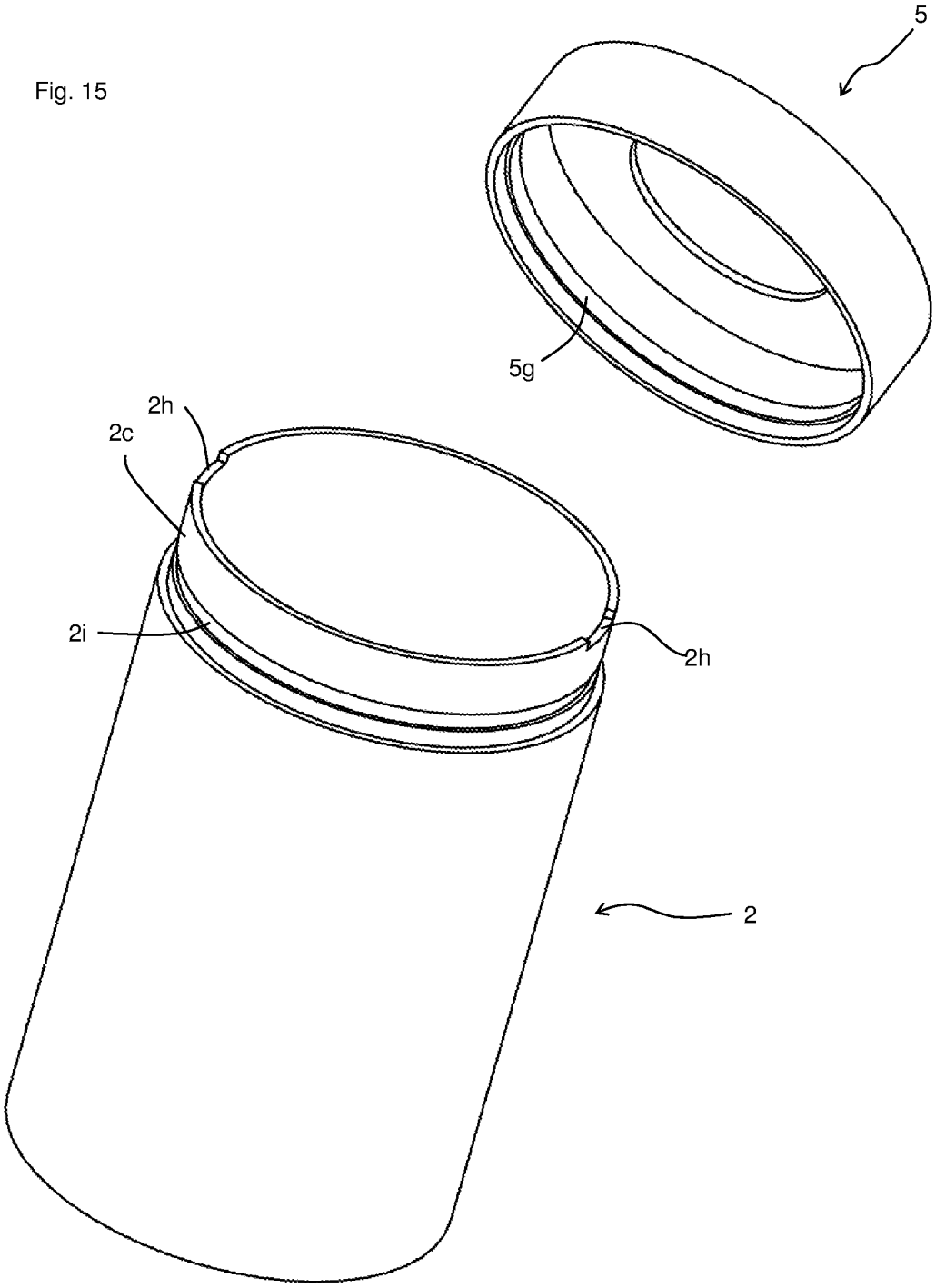
FIG. 15 is a perspective view of the outer case 2 and the fixing ring 5 of FIG. 14.
Figure 16:
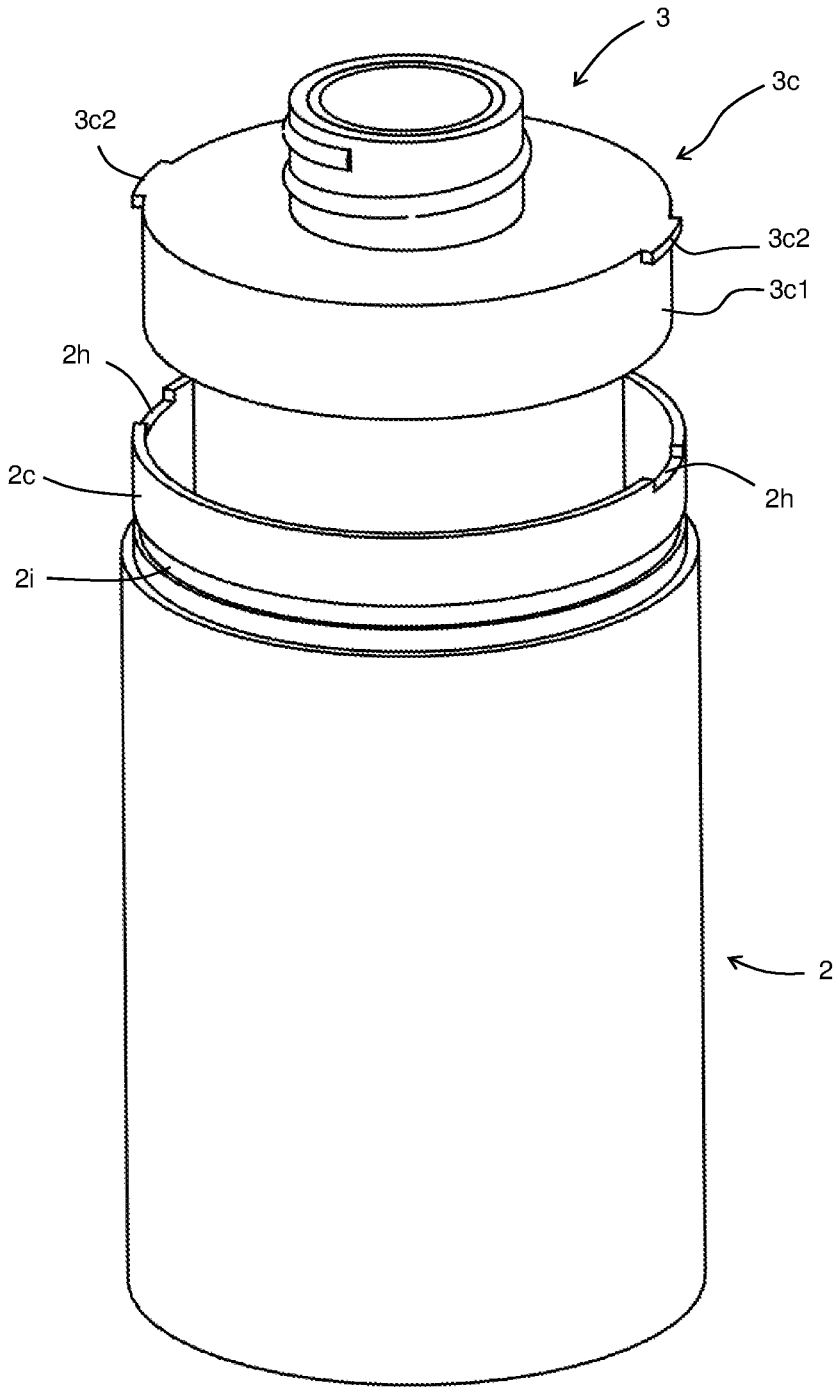
FIG. 16 is a perspective view of the outer case 2 and the container body 3 of FIG. 14.
Figure 17:
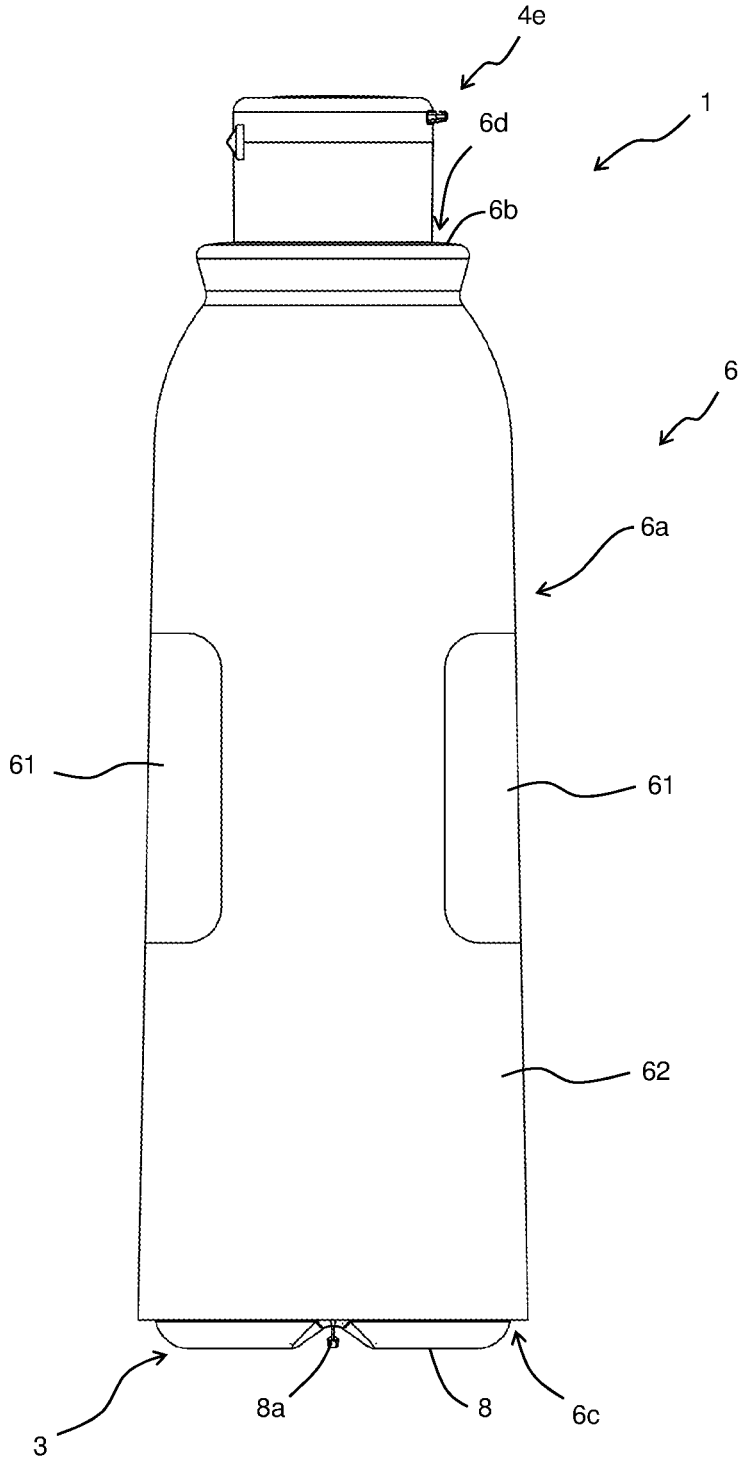
FIG. 17 is a front view of the delaminatable container 1 according to the fifth embodiment of the present invention.
Figure 18:
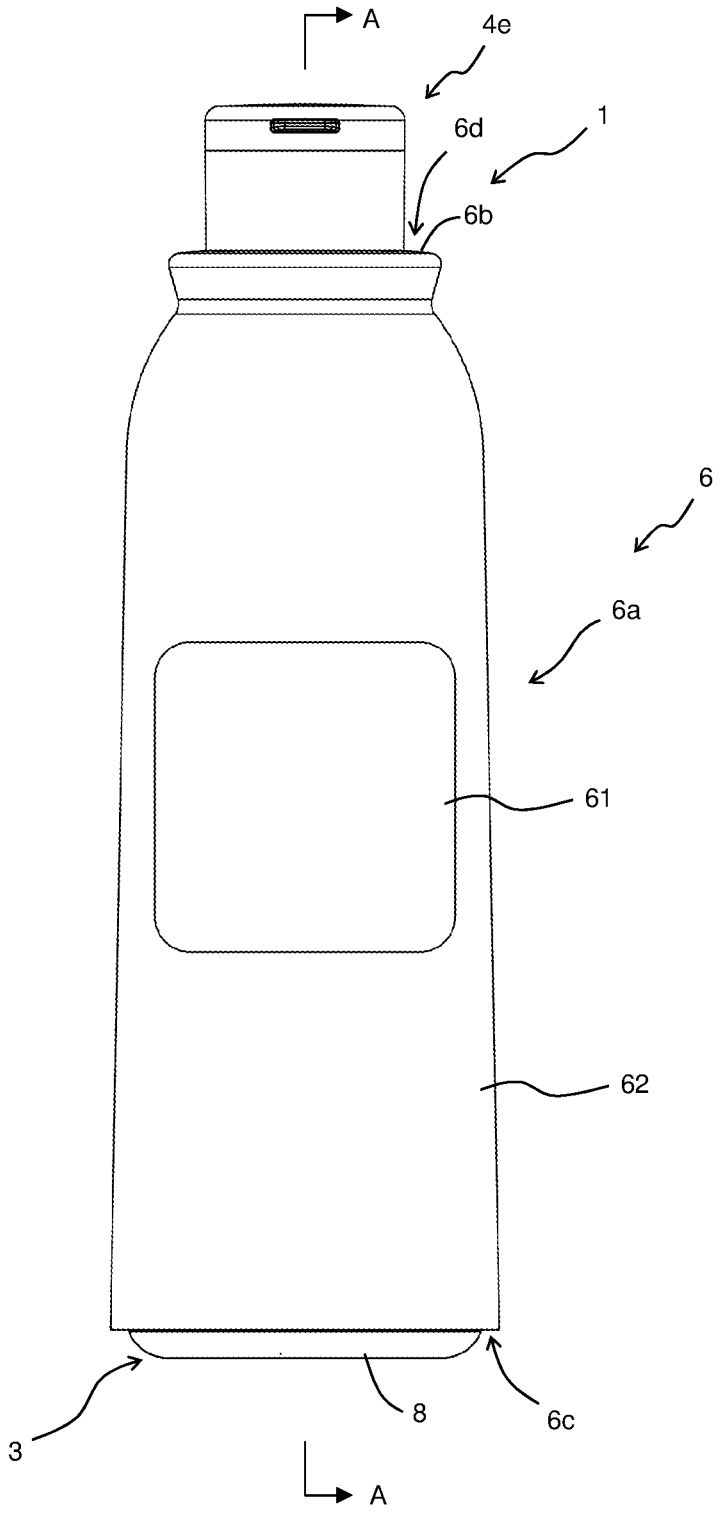
FIG. 18 is a right-side view of the delaminatable container 1 of FIG. 17.

The fourth embodiment of the present invention will be explained with reference to FIGS. 14 to 16. In the present embodiment, the basic constitution and the function thereof are the same as the first embodiment. The main difference is that the shape of the outer case 2, the container body 3, and the fixing ring 5 differ from those of the first embodiment. Hereinafter, such difference will be mainly explained.

In the present embodiment, the flanged portion 3*c* comprises an annular portion 3*c*1 and a projecting portion 3*c*2. The projecting portion 3*c*2 protrudes from the annular portion 3*c*1 in a radially outward direction. The projecting portion 3*c*2 is provided by a plurality of number (by two in the present embodiment) in a circumferential direction with an interval. The upper end of the outer case 2 is provided with a cutout portion 2*h*. The cutout portion 2*h* has a complementary shape with respect to the projecting portion 3*c*2. When the container body 3 is contained in the outer case 2, and the projecting portion 3*c*2 is engaged with the cutout portion 2*h*, the position of the container body 3 with respect to the outer case 2 is determined in the circumferential direction. Here, the annular portion 3*c*1 is not supported by the outer case 2.

In the reduced diameter portion 2*c* of the outer case 2, an annular recessed portion 2*i* is provided. On the inner circumference surface of the fixing ring 5, an annular projecting portion 5*g* is provided. When the reduced diameter portion 2*c* is inserted into the fixing ring 5, the annular recessed portion 2*i* and the annular projecting portion 5*g* engage with each other, and the fixing ring 5 is fixed with respect to the outer case 2.

5. Aspect of the Fifth to Seventh Embodiment (Conventional Technique)

Conventionally, there has been known a delaminatable container which can suppress air from coming into the container when the inner bag shrinks as the contents decrease (for example, Patent Document 2).

Problem

The delaminatable container of Patent Document 2 is structured by covering a containing portion of the container body with a shrink film, the container body being formed by blow forming. Here, there are cases where a luxurious appearance is required.

The present invention has been made by taking the afore-mentioned circumstances into consideration. The present invention provides a delaminatable container having a high degree of freedom regarding appearance design, and is capable of ejecting contents by applying a compressing force.

Means to Solve the Problem

According to the present invention, provided is a delaminatable container, comprising: a container body; and a tubular outer case being installed on the container body; wherein: the container body comprises a containing portion which contains contents, and a mouth portion which ejects the contents from the containing portion; the container body comprises an outer shell and an inner bag; the inner bag shrinks as contents decrease; the outer case is installed so as to cover at least a portion of the containing portion; and the delaminatable container is constituted so as to be capable of ejecting the contents from the mouth portion by deforming the outer case.

Regarding the delaminatable container of the present invention, at least a part of the containing portion is covered with the tubular outer case, achieving improved degree of freedom regarding the appearance design of the container. In addition, by selecting an outer case having a superior appearance, luxurious appearance can be achieved. Further, by selecting an outer case which is not deformed easily, it becomes impossible to eject the contents by applying pressurizing force to the container. In the present invention, an outer case which can be deformed is selected. Accordingly, the contents can be ejected even when the outer case is installed, by deforming the container body with the outer case.

6. Fifth Embodiment

The delaminatable container 1 according to the fifth embodiment of the present invention will be explained with reference to FIGS. 17 to 24. The delaminatable container 1 of the present embodiment comprises a container body 3, a cap 4*e*, a valve member 11, and an outer case 6.

<Container Body 3, Cap 4*e*, Valve Member 11>

Figure 19:
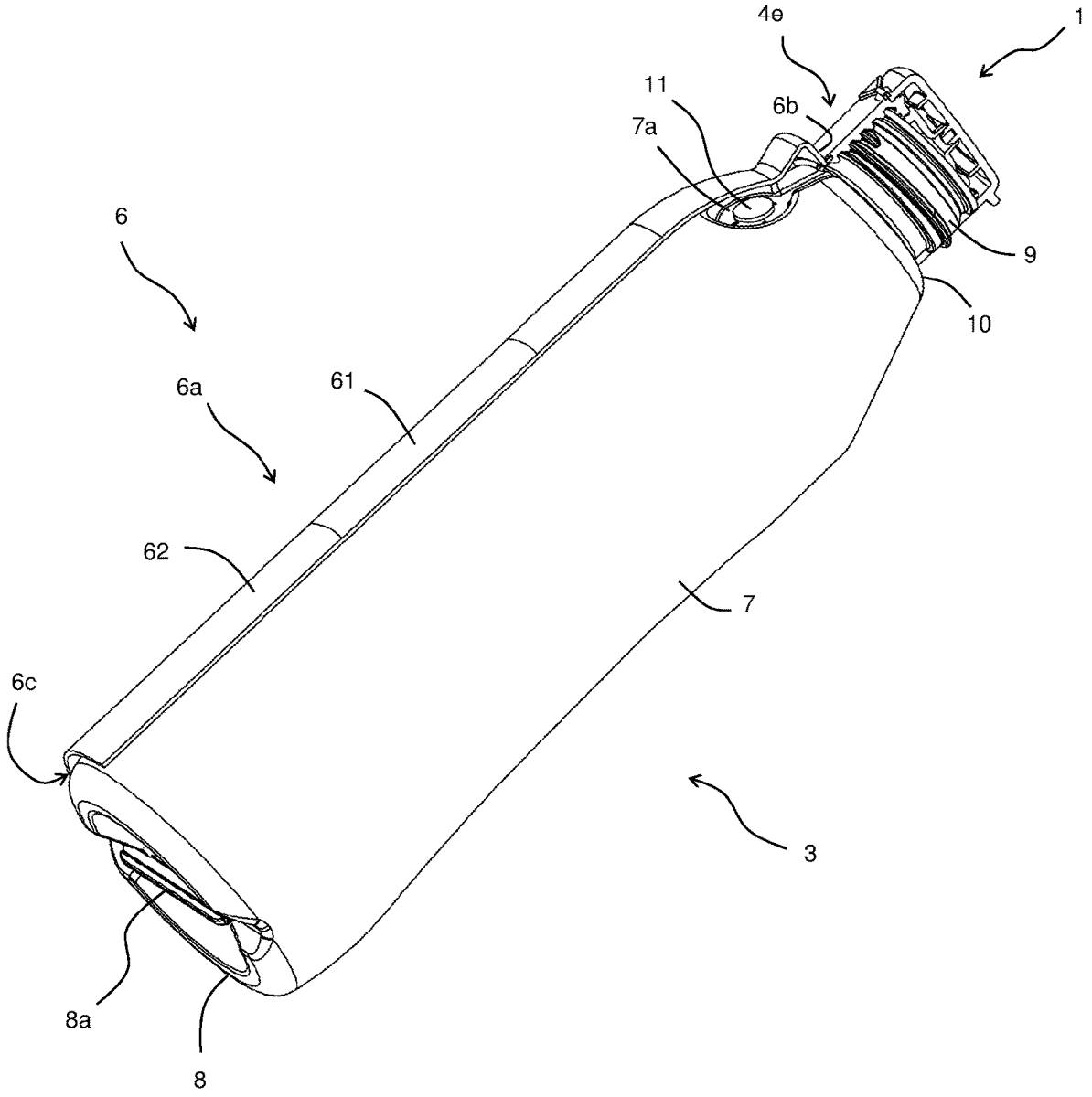
FIG. 19 is a perspective view showing a condition in which the cap 4*e* and the outer case 6 of the delaminatable container 1 of FIG. 17 are split in halves.

As shown in FIG. 19, the container body 3 comprises a containing portion 7 which contains the contents, and a mouth portion 9 which ejects the contents from the containing portion 7. The container body 3 comprises an outer shell 12 and an inner bag 14 in the containing portion 7 and the mouth portion 9. As the contents decrease, the inner bag 14 separates from the outer shell 12 and shrinks.

A bottom 8 is provided at one end of the containing portion 7. A shoulder 10 is provided in between the containing portion 7 and the mouth portion 9. The outer diameter of the containing portion 7 is larger than the mouth portion 9, and the outer diameter is enlarged at the shoulder 10. The bottom 8 is provided with a seal portion 8*a* to seal each of the outer shell 12 and the inner bag 14. The seal portion 8*a* is a seal portion of the laminated parison formed when blow molding is performed with the laminated parison.

The mouth portion 9 is provided with an engaging portion 9*d* which can engage with the cap 4*e* equipped with a check valve. The cap 4*e* can be installed by capping, or can be installed by screw.

Figure 20:
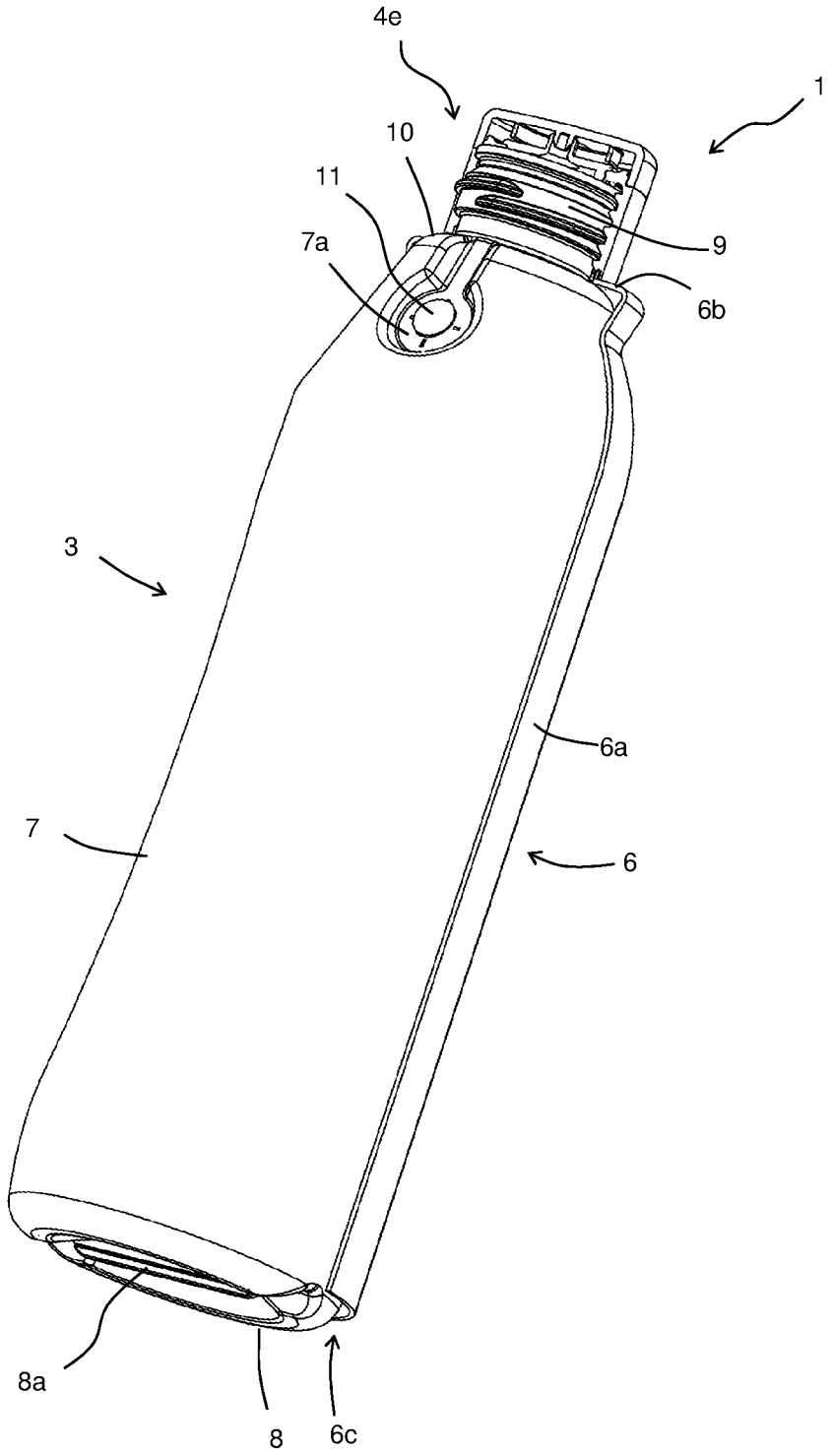
FIG. 20 is a perspective view showing a condition in which the cap 4*e* and the outer case 6 of the delaminatable container 1 of FIG. 17 are split in halves in another direction.
Figure 21:
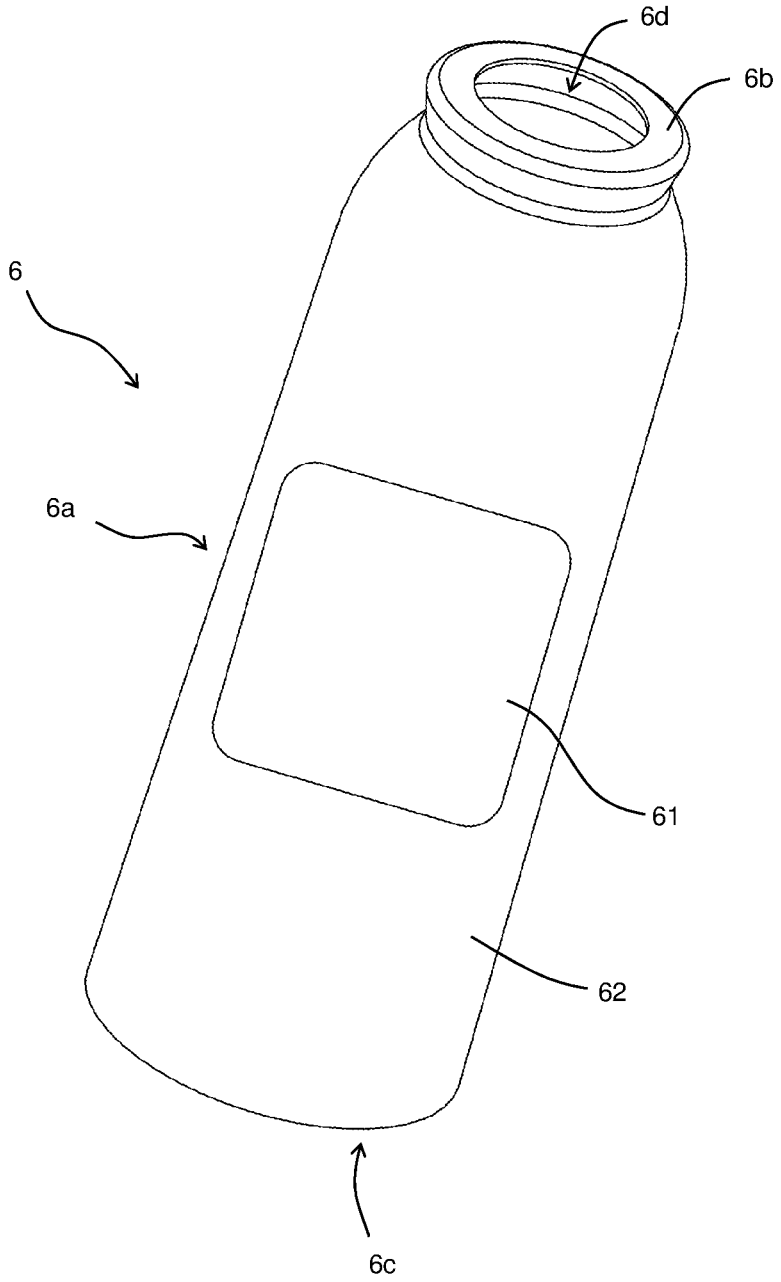
FIG. 21 is a perspective view of the outer case 6 of FIG. 17.

As shown in FIGS. 19 to 20, the containing portion 7 is provided with a recessed portion 7*a*, and the recessed portion 7*a* is provided with an outer-air introducing hole 15. The outer-air introducing hole 15 is a through-hole provided only to the outer shell 12, and allows the intermediate space 21 positioned in between the outer shell 12 and the inner bag 14 to communicate with the outer space S of the container body 3.

Figure 22:
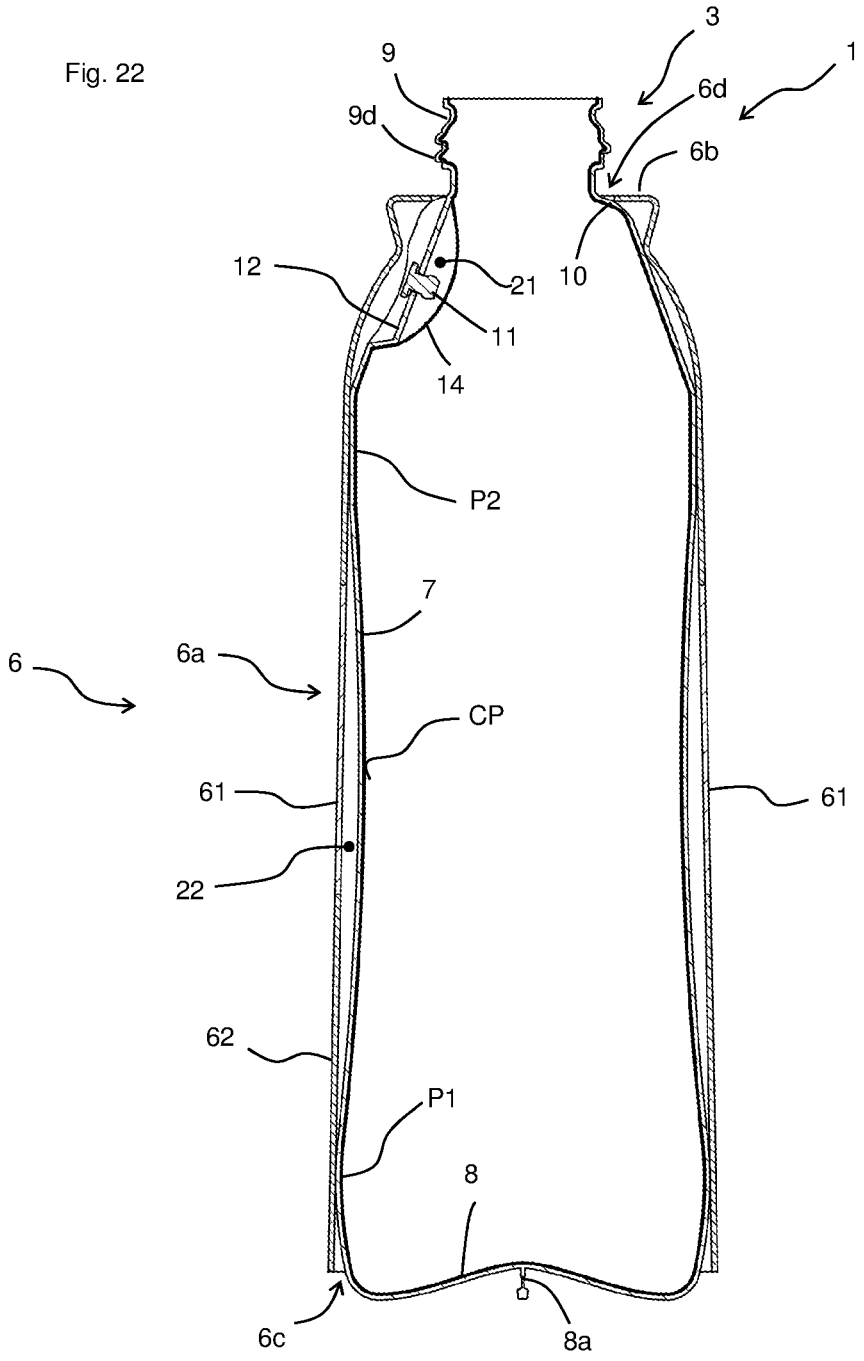
FIG. 22 is a cross sectional view of the delaminatable container 1 in a condition where the cap 4*e* is removed, taken along the line A-A of FIG. 18.
Figure 23:
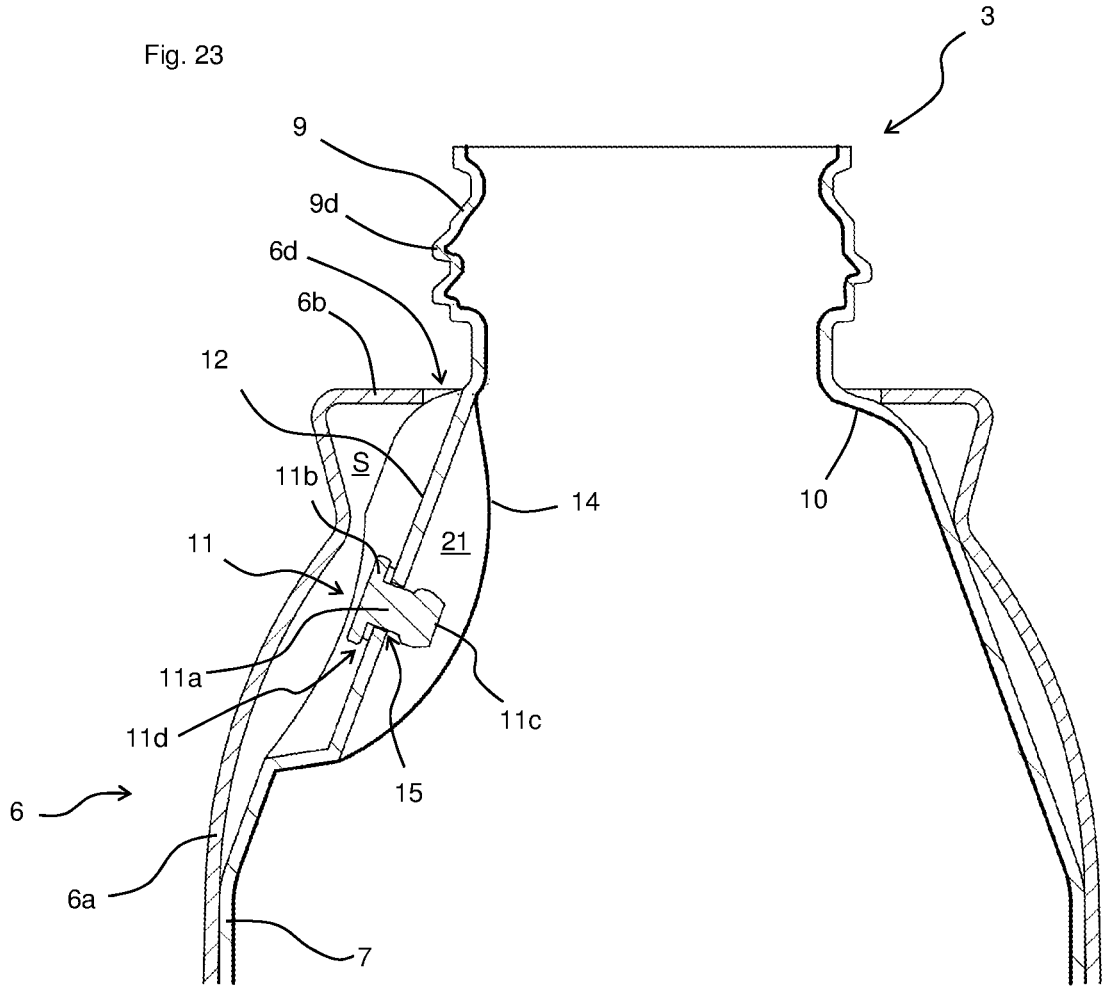
FIG. 23 is an enlarged view of the mouth portion 9 of FIG. 22.
Figure 24:
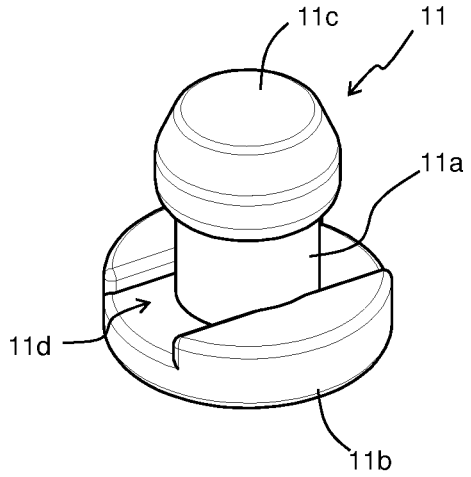
FIG. 24 is a perspective view of the valve member 11 of FIG. 23.
Figure 25:
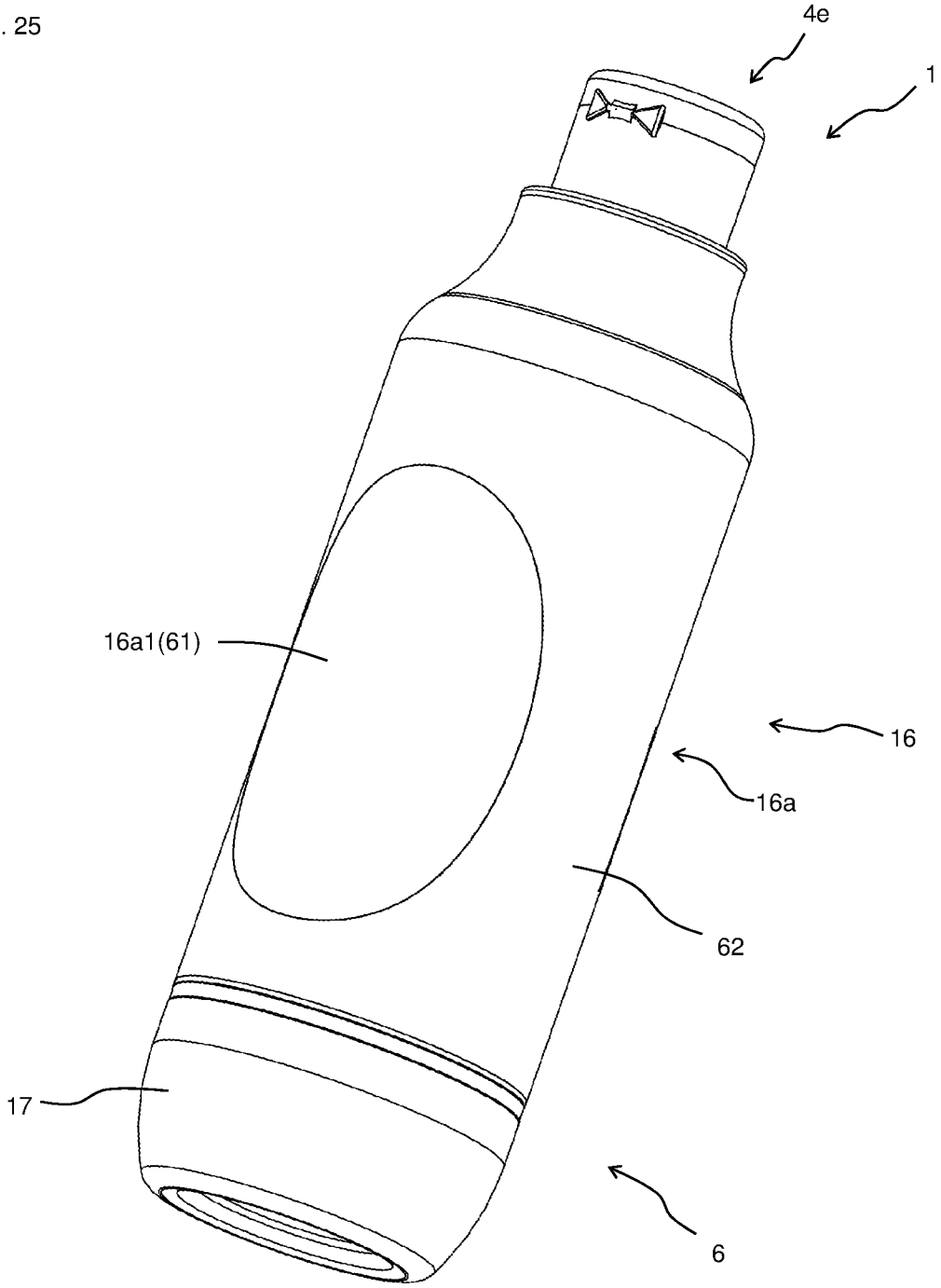
FIG. 25 is a perspective view of the delaminatable container 1 according to the sixth embodiment of the present invention.
Figure 26:
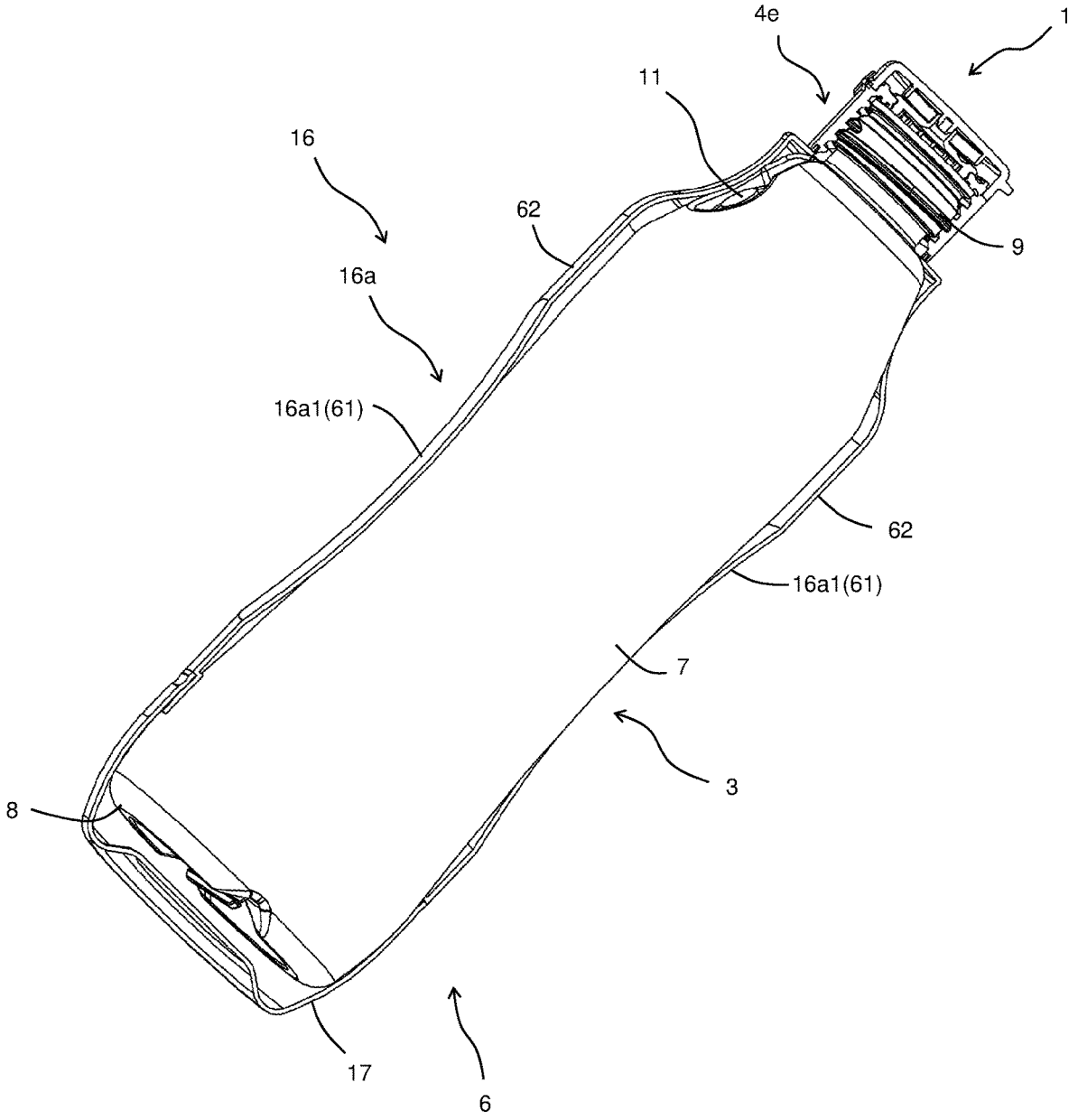
FIG. 26 is a perspective view showing a condition in which the cap 4*e* and the outer case 6 of the delaminatable container 1 of FIG. 25 are split in halves.
Figure 27:
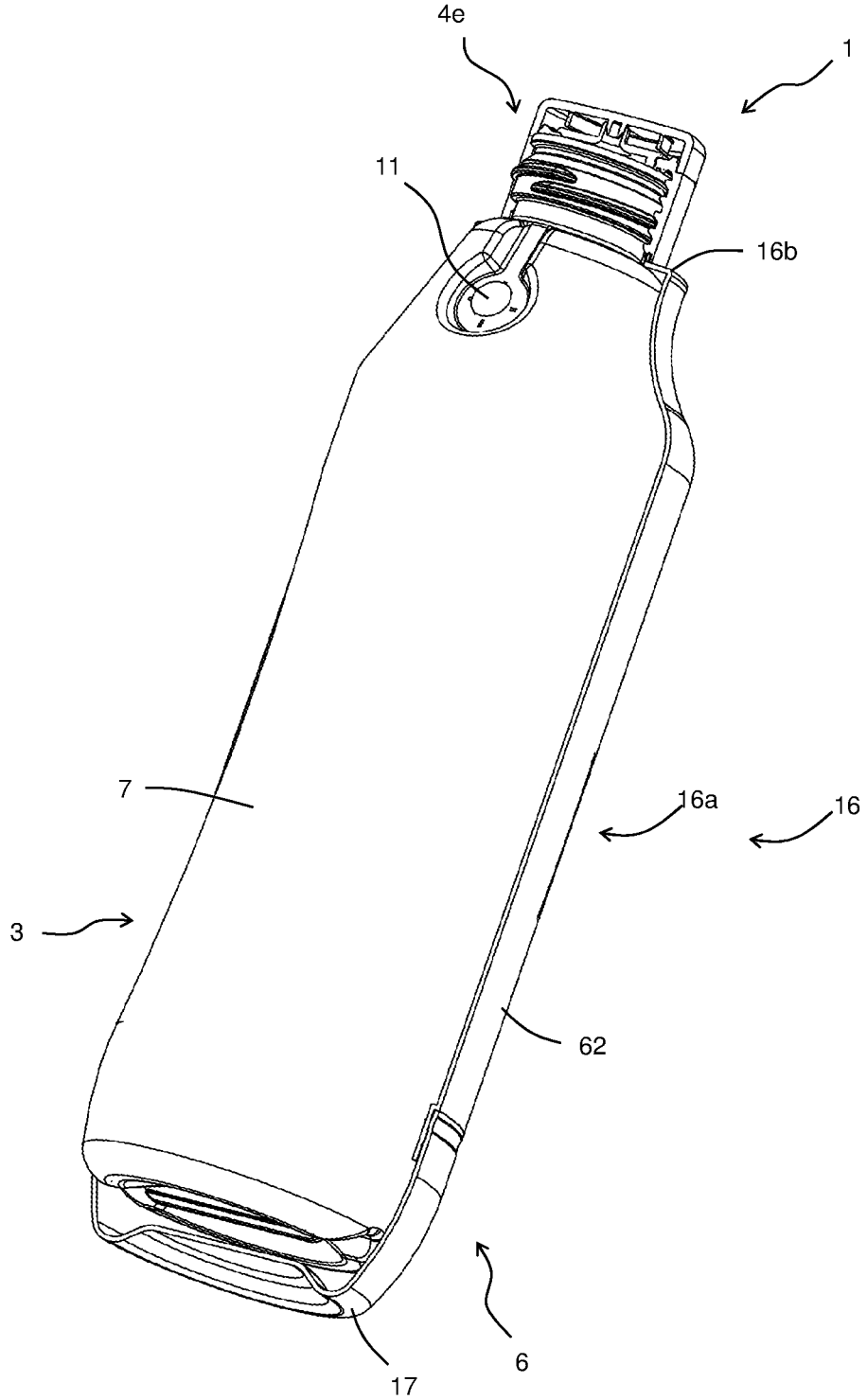
FIG. 27 is a perspective view showing a condition in which the cap 4*e* and the outer case 6 of the delaminatable container 1 of FIG. 25 are split in halves in another direction.
Figure 28:
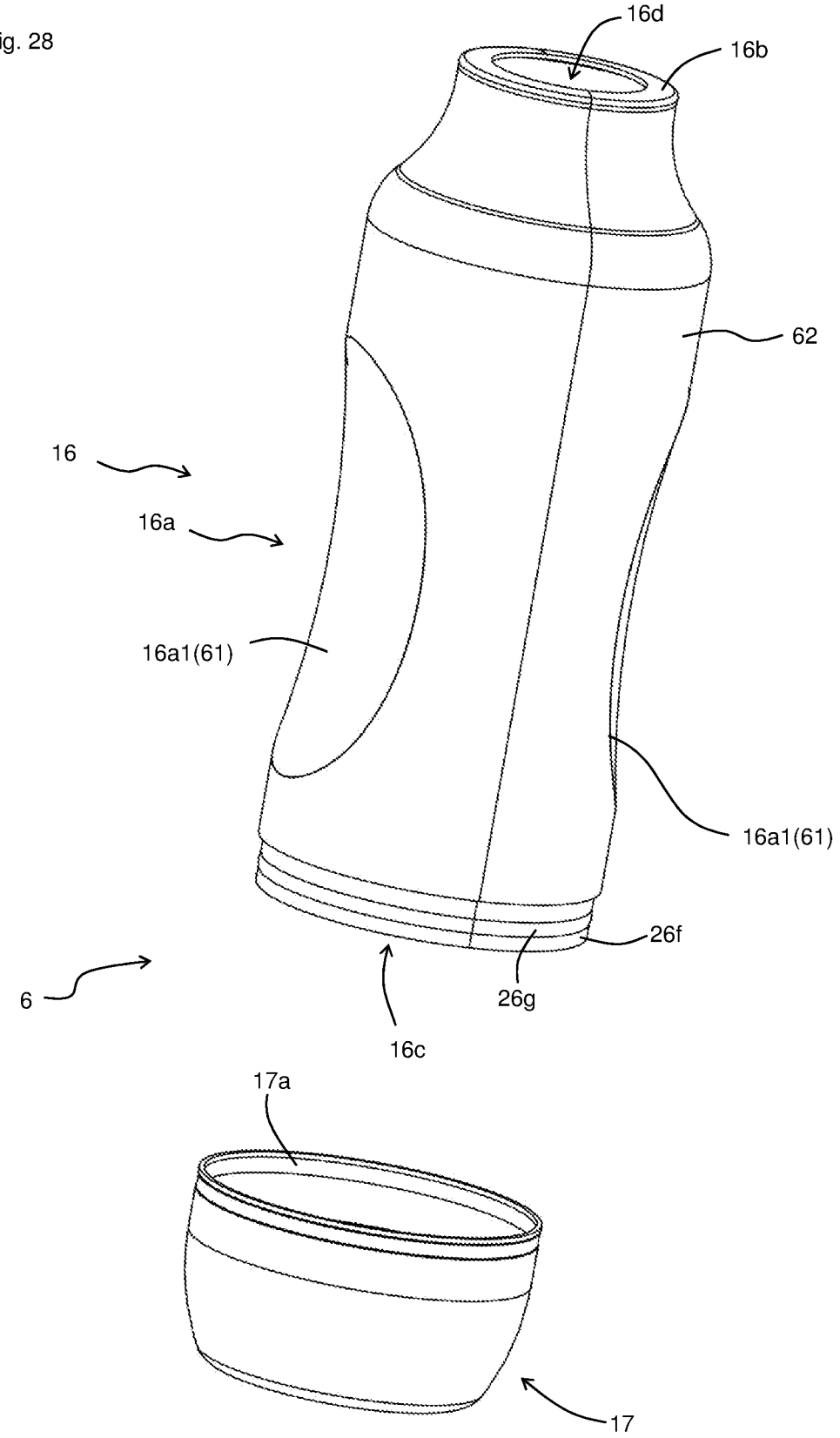
FIG. 28 is a perspective view showing a condition in which the outer case 6 of FIG. 25 is disassembled into the body member 16 and the bottom 17.

As shown in FIGS. 22 to 24, the valve member 11 comprises a shaft 11*a* which is inserted through the outer-air introducing hole 15 and is slidable with respect to the outer-air introducing hole 15, a lid 11*c* which is provided at the intermediate space 21 side with respect to the shaft 11*a* and has a cross sectional area larger than the shaft 11*a*, and a locking member 11*b* which is provided at the outer space S side of the shaft 11*a* and prevents the valve member 11 from coming into the intermediate space 21.

The lid 11*c* is structured so as to substantially close the outer-air introducing hole 15 when the outer shell 12 is compressed. Accordingly, the lid 11*c* has a shape in which the cross sectional area decreases towards the shaft 11*a*. In addition, the locking member 11*b* is structured so as to introduce air into the intermediate space 21 when the outer shell 12 restores its shape after being compressed. When the outer shell 12 is compressed, the pressure inside the intermediate space 21 becomes higher than the outer pressure, and thus the air inside the intermediate space 21 flows outside from the outer-air introducing hole 15. The difference in the pressure and the air flow allows the lid 11*c* to move towards the outer-air introducing hole 15, and the lid 11*c* closes the outer-air introducing hole 15. Since the lid 11*c* has a shape in which the cross sectional area decreases towards the shaft 11*a*, the lid 11*c* easily fits the outer-air introducing hole 15, thereby closing the outer-air introducing hole 15.

When the outer shell 12 is further compressed in such condition, the pressure inside the intermediate space 21 is further increased. As a result, the inner bag 14 is compressed, and the contents inside the inner bag 14 is ejected. In addition, when the pressing force is released, the outer shell 12 restores its shape by its own elasticity. In such case, the lid 11*c* separates from the outer-air introducing hole 15, and the closure of the outer-air introducing hole 15 is released, thereby allowing the outer-air to be introduced into the intermediate space 21. Further, a flow passage 11*d* is provided in the locking member lib, so that the locking member lib would not close the outer-air introducing hole 15. Accordingly, even when the locking member lib is in contact with the outer shell 12, the outer-air can be introduced into the intermediate space 21 through the flow passage 11*d* and the outer-air introducing hole 15.

The constitution of the layers of the container body 3 will be explained in detail. The container body 3 comprises an outer shell 12 and an inner bag 14. The outer shell 12 is formed thicker than the inner bag 14 in order to achieve high restoring property. The constitution of the layers of the outer shell 12 and the inner bag 14 are the same as explained in the first embodiment.

<Outer Case 6>

The outer case 6 has a tubular shape, and is installed so as to cover at least a portion of the containing portion 7. The outer case 6 comprises a body portion 6*a*, an upper wall 6*b*, an opening portion 6*c* at the bottom 8 side, and an opening portion 6*d* at the mouth portion 9 side. The body portion 6*a* has a substantially cylindrical shape, and the cross sectional area is substantially the same in the height direction of the containing portion 7. The containing portion 7 has a decreased diameter near the central portion CP in the height direction of the containing portion 7. As shown in FIG. 22, a gap 22 is provided in between the containing portion 7 and the outer case 6. This gap 22 improves the heat insulating property of the delaminatable container 1. On the other hand, the containing portion 7 contacts the outer case 6 at a position lower than the central portion CP (P1) and at a position higher than the central portion (P2).

A bottom wall is not provided at the bottom 8 side of the outer case 6. The opening portion 6*c* matches with the shape of the inner surface of the body portion 6*a*. The opening portion 6*d* is smaller than the opening portion 6*c*. The opening portion 6*d* is larger than the outer diameter of the mouth portion 9, and is smaller than the outer diameter of the shoulder 10. Accordingly, when the outer case 6 is installed so as to cover from the mouth portion 9 side, the upper wall 6*b* contacts the shoulder 10, and thus the position of the outer case 6 with respect to the container body 3 is determined in the height direction.

As shown in FIGS. 19 to 20, the upper wall 6*b* is disposed in between the cap 4*e* and the shoulder 10. Accordingly, when the cap 4*e* is tightened, the upper wall 6*b* is clamped and fixed by the cap 4*e* and the shoulder 10.

The outer case 6 is formed with a thickness and a material so as to allow easy deformation. When a pressing force is applied to the outer case 6 in a condition where the outer case 6 is installed on the container body 3, thereby deforming the outer case 6, the inner bag 14 is compressed via the outer shell 12 and the intermediate space 21, allowing the contents inside the inner bag 14 to be ejected.

It is preferable that the outer case 6 has an adequate restoring ability, thereby allowing the outer case 6 to restore its original shape by its restoring ability when the pressing force is removed after the outer case 6 is deformed by applying the pressing force. In such case, the outer case 6 can be repetitively deformed to eject the contents repetitively.

In particular, the outer case 6 is preferably constituted so that the maximum push-in amount is 5 mm or larger when a pressing force of 2 kg is applied with an indenter having 15 mm diameter. In such case the outer case 6 is easily deformed sufficiently, and the contents can be ejected easily. The maximum push-in amount mentioned here is a maximum value obtained by measuring the push-in amount at various positions of the outer case 6, and corresponds to the push-in amount at a position where it is most easily dented within the outer case 6. The maximum value is, for example, 5 to 40 mm, and is specifically for example, 5, 10, 15, 20, 25, 30, 35, or 40 mm, and can be in the range between the two values exemplified herein. In addition, the value of (maximum push-in amount)/(diameter of containing portion 7) is preferably 0.1 or more, and is 0.1 to 0.7 for example. The value of (maximum push-in amount)/(diameter of containing portion 7) is specifically for example, 0.1, 0.2, 0.3, 0.4, 0.5, 0.6, or 0.7, and can be in the range between the two values exemplified herein.

The outer case 6 is further preferably structured so that the maximum push-in amount at the position facing the center in the height direction of the containing portion 7 has the value mentioned above. When the contents are ejected, the portion in the vicinity of the center of the containing portion 7 in the height direction is compressed in many cases, and thus it is preferable that the outer case 6 is easily deformed at this position.

The material of the outer case 6 is not particularly limited so long as the outer case 6 can be deformed by applying a pressing force. The outer case 6 is an injection molded body for example. The appearance of the outer case 6 can be improved by forming the outer case 6 by injection molding.

The thickness of the outer case 6 is preferably 0.2 mm or more, and is more preferably 0.5 mm or more. The thickness is 0.2 to 3 mm for example, and is specifically for example, 0.2, 0.5, 1, 1.5, 2, 2.5 or 3 mm, and can be in the range between the two values exemplified herein.

The outer case 6 comprises a first region 61 and a second region 62. The first region 61 is disposed at a position facing the center of the containing portion in a height direction, and it is intended so that the contents are ejected by applying pressing force to the first region 61. Accordingly, it is preferable that the outer case 6 is easily deformed in the first region 61, and it is preferable that the maximum push-in amount in the first region 61 satisfies the afore-mentioned value.

In order to allow the outer case 6 to be deformed easily in the first region 61, it is preferable to form the first region 61 with a first material having a lower bending elastic modulus (sofut material) than that of the second material structuring the second region 62. Such outer case 6 can be formed by two-color molding, insert molding and the like. As the first material, elastomers (olefin-based elastomer, styrene-based elastomer, and the like), natural rubber, synthetic rubber (silicone rubber and the like), EVA, low density polyethylene, soft polyvinyl chloride, and a material having these materials laminated can be mentioned for example. As the second material, resin material (high density polyethylene, polypropylene, PET, acrylic resin, nylon resin, ABS resin, hard polyvinyl chloride, polystyrene, fiber reinforced plastic and the like), wood, metal, glass, earthenware, and a material having these materials laminated can be mentioned for example.

Further, the thickness of the first region 61 can be made thinner than the thickness of the second region 62 so that the outer case 6 is easily deformed in the first region 61. In such case, the value of (thickness of the first region 61)/(thickness of the second region 62) is preferably 0.95 or lower. The value is, for example, 0.3 to 0.95, and is specifically for example, 0.3, 0.35, 0.4, 0.45, 0.5, 0.55, 0.6, 0.65, 0.7, 0.75, 0.8, 0.85, 0.9, or 0.95, and can be in the range between the two values exemplified herein.

The outer case 6 can be provided with a decoration on the outer surface to further improve appearance.

7. Sixth Embodiment

The delaminatable container 1 according to the sixth embodiment of the present invention will be explained with reference to FIGS. 25 to 29. The present embodiment differs from the fifth embodiment in the constitution of the outer case 6. The container body 3, the cap **4*e*, and the valve member 11** have the same constitutions as those of the fifth embodiment.

In the present embodiment, the outer case 6 comprises a body member 16 and a bottom 17. The body member 16 is disposed at a position closer to the mouth portion 9 than the bottom 17.

The body member 16 comprises a body portion **16*a*, an upper wall 16*b*, an opening portion 16*c* at the bottom 8 side, and an opening portion 16*d* at the mouth portion 9 side. On the body portion 16*a*, a panel portion 16*a*1 is formed by recessing the body portion 16*a*. The panel portion 16*a*1 corresponds to the first region 61, and the other portions correspond to the second region 62, and it is intended so that the contents are ejected by applying a pressing force to the panel portion 16*a*1. Accordingly, it is preferable that the panel portion 16*a*1 is formed with a softer material than the material which forms the other portions. The body member 16** can be formed by two-color molding.

A bottom wall is not provided at the bottom 8 side of the body member 16. The opening portion **16*c* matches with the shape of the inner surface of the body portion 16*a*. The opening portion 16*d* is smaller than the opening portion 16*c*. The opening portion 16*d* is larger than the outer diameter of the mouth portion 9, and is smaller than the outer diameter of the shoulder 10. Accordingly, when the body member 16 is installed, the upper wall 16*b* contacts the shoulder 10, and thus the position of the body member 16 with respect to the container body 3** is determined in the height direction.

Figure 29:
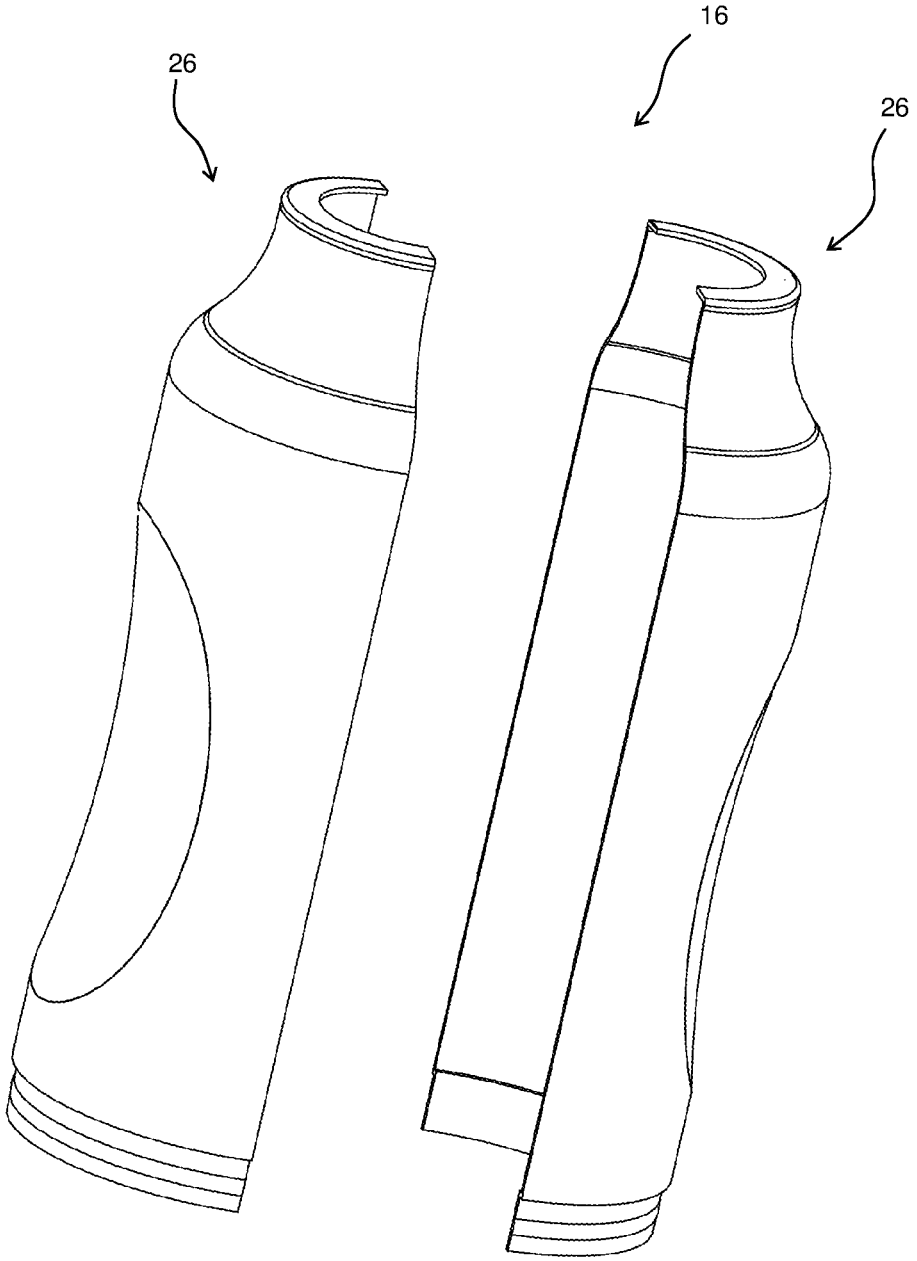
FIG. 29 is a perspective view of the body member 16 in a condition where the body member 16 is disassembled into a pair of body constituent members 26.

The body member 16 has its panel portion **16*a*1 recessed, and the inner diameter of the body member 16 at the panel portion 16*a*1 is smaller than the outer diameter of the containing portion 7 at a position higher than the panel portion 16*a*1. Accordingly, the body member 16 cannot be installed by covering from the mouth portion 9 side. Therefore, in the present embodiment, as shown in FIG. 29, the body member 16 is structured by combining a pair of body constituent members 26. The pair of the body constituent members 26** preferably have the same shape.

A reduced diameter portion **26*f* is provided at the bottom end of the body member 16, and an annular projecting portion 26*g* projecting in a radially outward direction is provided at the reduced diameter portion 26*f*. In addition, an annular projecting portion 17*a* projecting in a radially inward direction is provided at the vicinity of the upper end of the bottom 17. The projecting portion 26*g* and the projecting portion 17***a* are engaged by inserting the reduced diameter portion 26*f* into the bottom 17. Accordingly, the body member 16 and the bottom 17 are engaged to structure an integrated outer case 6.

8. Seventh Embodiment

Figure 30:
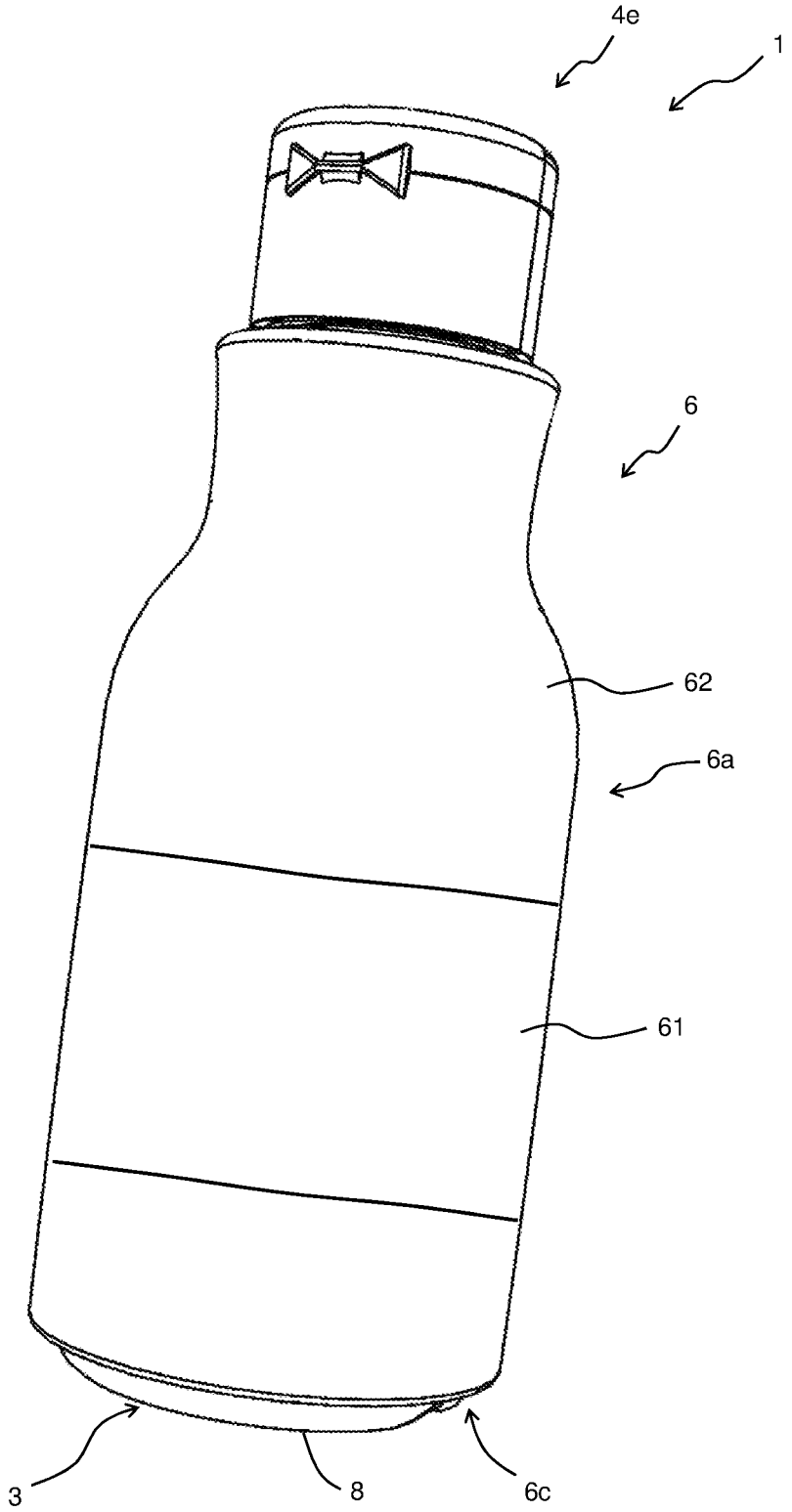
FIG. 30 is a perspective view of the delaminatable container 1 according the seventh embodiment of the present invention.

The delaminatable container 1 according to the seventh embodiment of the present invention will be explained with reference to FIGS. 30 to 32. The present embodiment is similar to the fifth embodiment. The main difference is the shape of the container body 3 and the first region 61. Hereinafter, such difference will be mainly explained.

Figure 31:
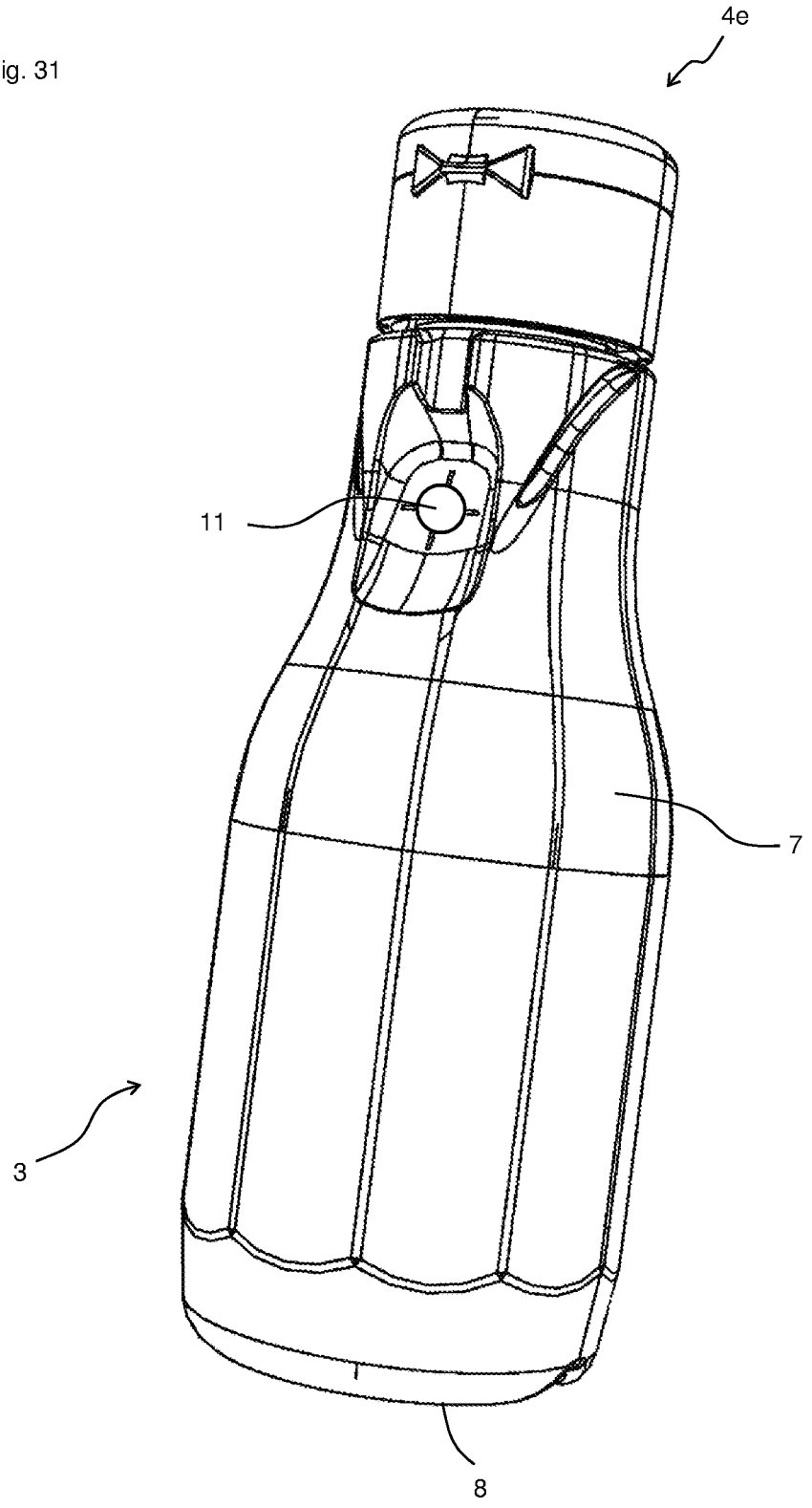
FIG. 31 is a perspective view of the container body 3 and the cap 4*e* of FIG. 30.
Figure 32:
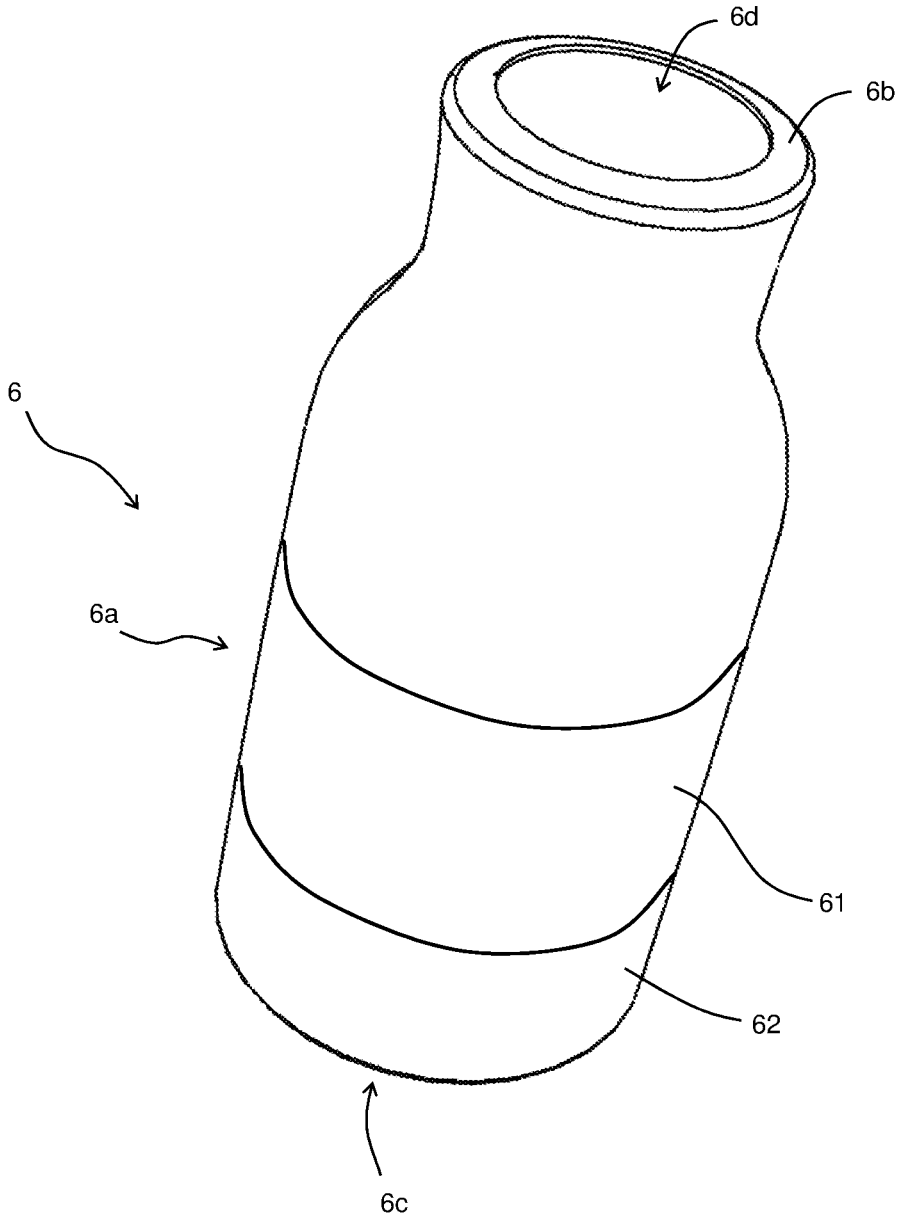
FIG. 32 is a perspective view of the outer case 6 of FIG. 30.
Figure 33:
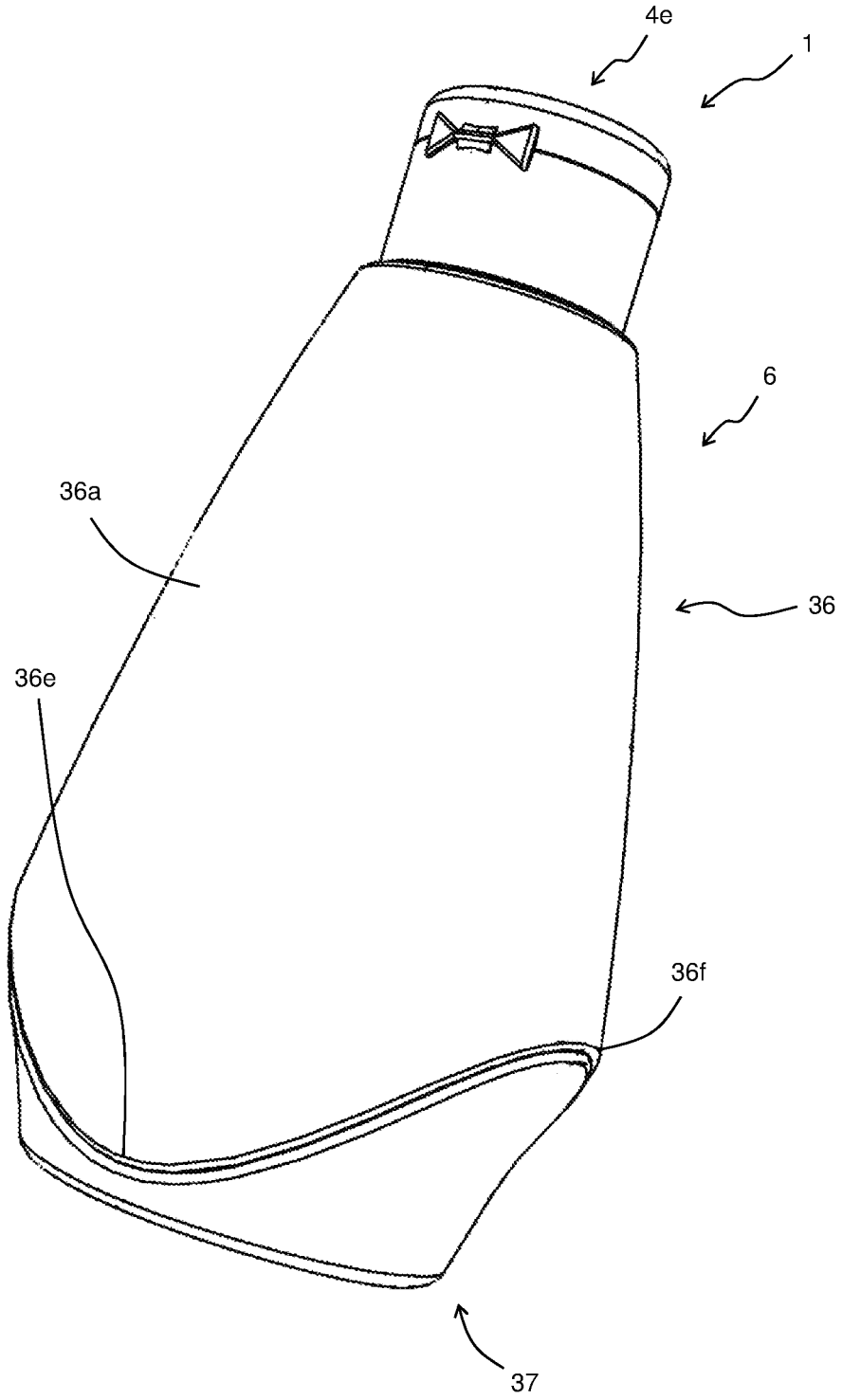
FIG. 33 is a perspective view of the delaminatable container 1 according to the eighth embodiment of the present invention.
Figure 34:
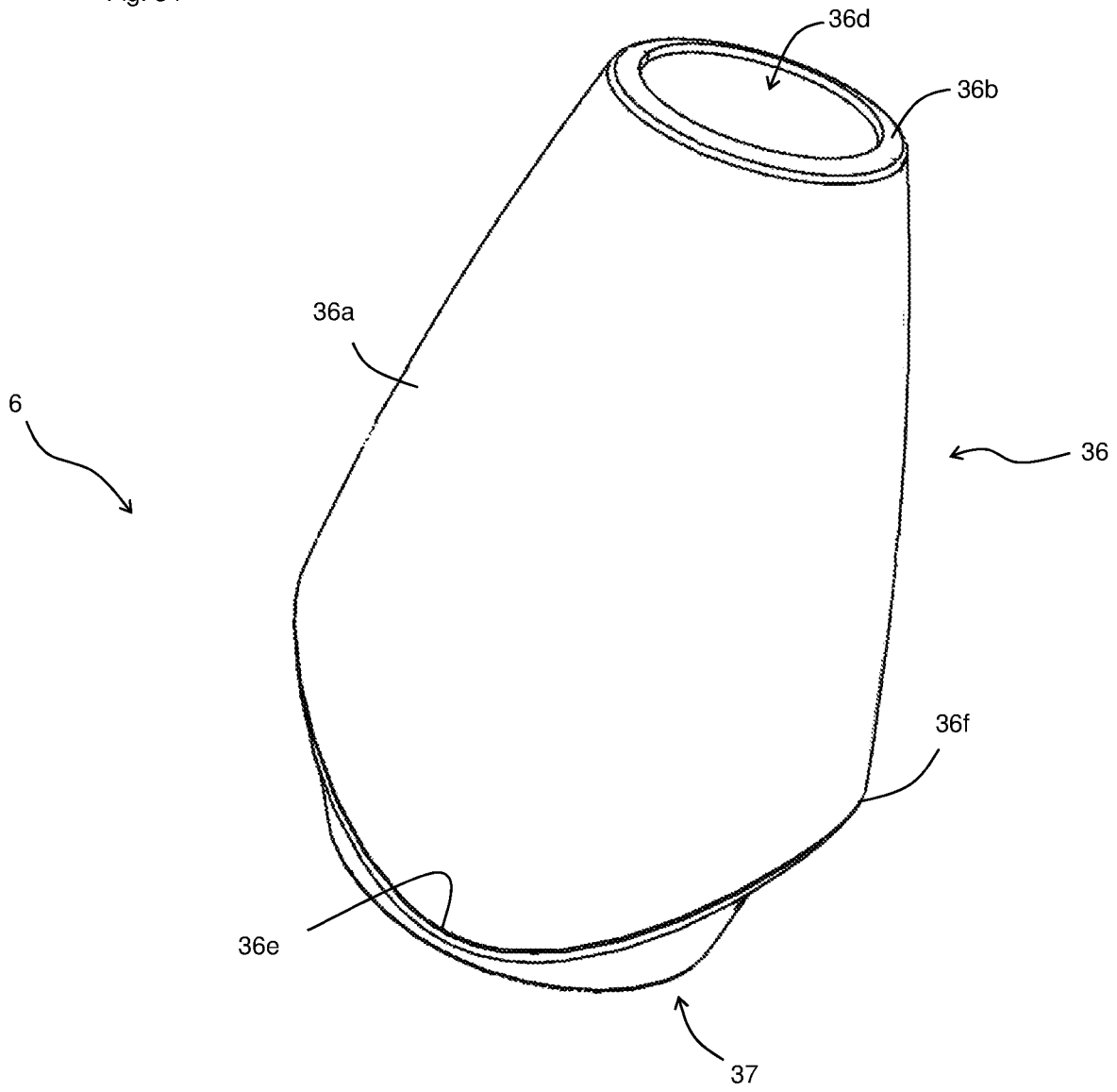
FIG. 34 is a perspective view of the outer case 6 of FIG. 33.
Figure 35:
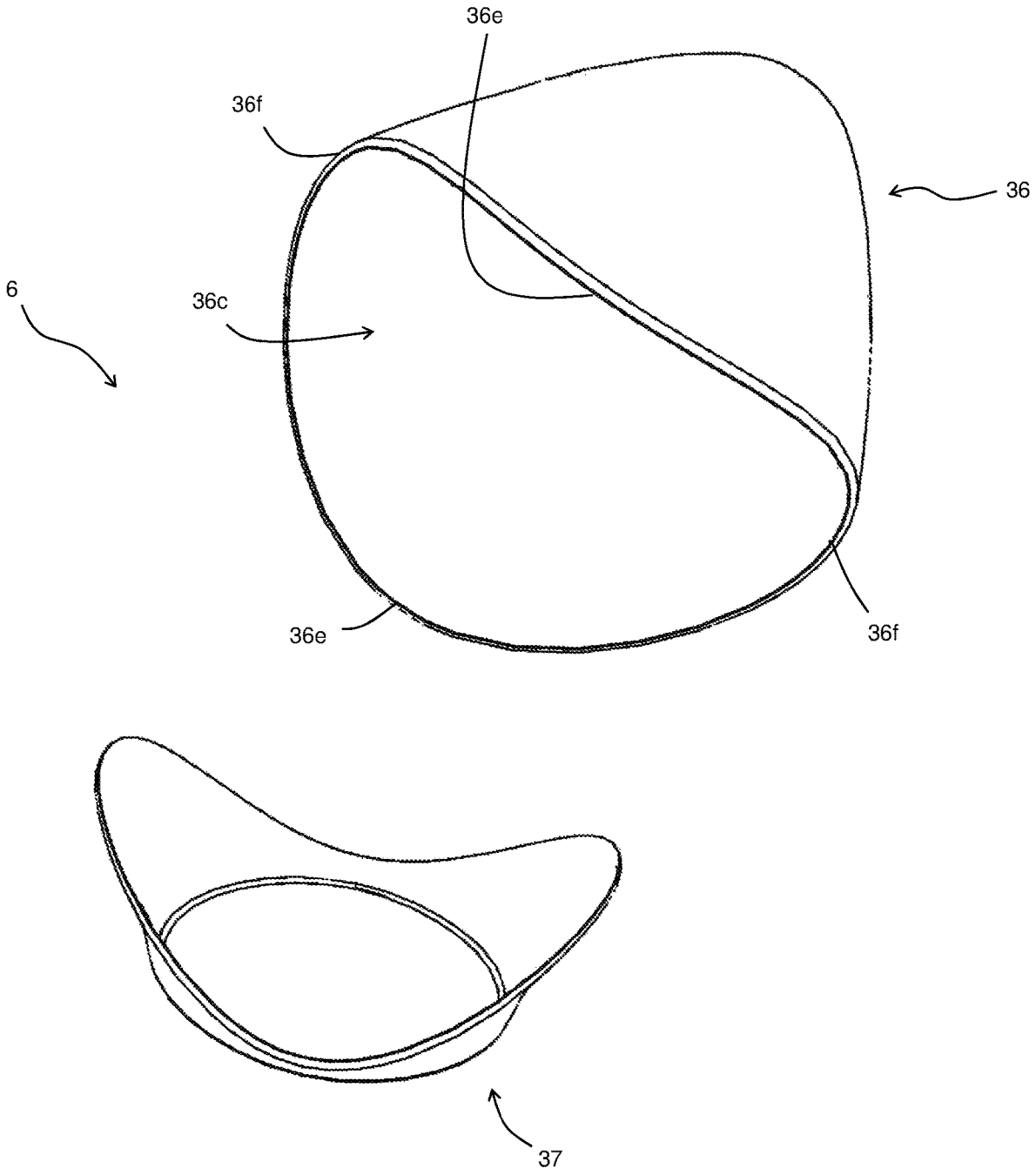
FIG. 35 is a perspective view showing a condition in which the outer case 6 of FIG. 34 is disassembled into the body member 36 and the bottom 37.

The container body 3 of the present embodiment has a shape shown FIG. 31, and the basic constitution and the function are the same as the fifth embodiment. The first region 61 of the present embodiment is provided throughout the entire circumferential direction. With such constitution, the contents can be ejected by pressing an arbitrary position in the circumferential direction in the vicinity of the central portion in the height direction of the containing portion 7.

9. Eighth Embodiment

The delaminatable container 1 according to the eighth embodiment of the present invention will be explained with reference to FIGS. 33 to 36. The present embodiment is similar with the seventh embodiment. The main difference is the constitution of the outer case 6. Hereinafter, such difference will be mainly explained.

The constitution of the container body 3 of the present embodiment is the same as the seventh embodiment. The outer case 6 comprises a body member 36 and a bottom 37. The body member 36 is disposed at a position closer to the mouth portion 9 than the bottom 37. The body member 36 and the bottom 37 can be formed by injection molding.

The body member 36 comprises a body portion 36*a*, an upper wall 36*b*, an opening portion 36*c* at the bottom 8 side, and an opening portion 36*d* at the mouth portion 9. The body portion 36*a* is shaped so as to have a circular cross sectional area at the mouth portion 9 side, and an oval cross sectional area at the bottom 8 side. That is, the shape of the cross sectional area of the body portion 36*a* changes gradually from a circle to an oval from the mouth portion 9 towards the bottom 8. In addition, the shape of the cross sectional area of the body portion 36*a* is enlarged gradually from the mouth portion 9 towards the bottom 8. A bottom wall is not provided at the bottom 8 side of the body member 36. The opening portion 36*c* matches with the shape of the inner surface of the body portion 36*a* at the bottom 8 side. The opening portion 36*d* is smaller than the opening portion 36*c*. The opening portion 36*d* is larger than the outer diameter of the mouth portion 9, and is smaller than the outer diameter of the shoulder 10. Accordingly, when the body member 36 is installed so as to cover from the mouth portion 9 side, the upper wall 36*b* contacts the shoulder 10, and thus the position of the body member 36 with respect to the container body 3 is determined in the height direction.

The body member 36 comprises a pair of projected portions 36*e*. The pair of projected portions 36*e* face each other, and each projects towards the bottom 8. A pair of base portions 36*f* are provided in between the pair of projected portions 36*e*. The pair of base portions 36*f* face each other. At the end portion of the bottom 8 side of the body member 36, a projected portion 36*e*, a base portion 36*f*, a projected portion 36*e*, and a base portion 36*f* are aligned in this order and have a wave-form shape.

Figure 36:
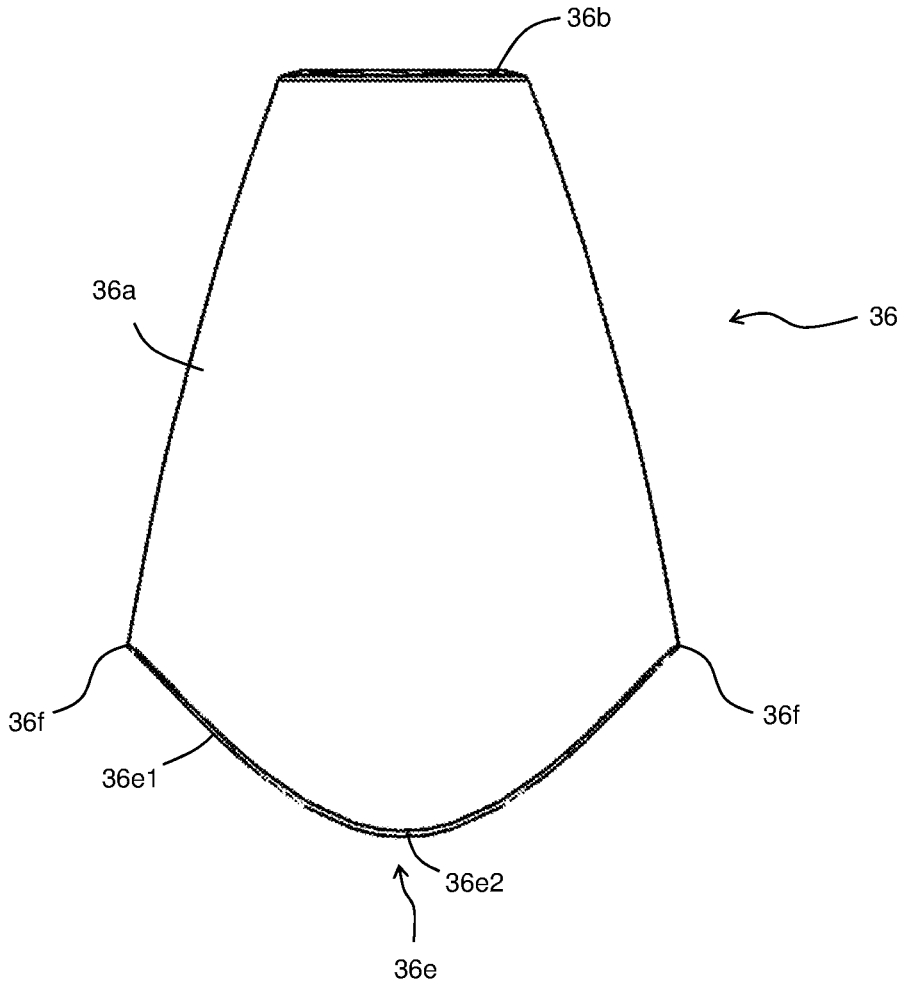
FIG. 36 is a front view of the body member 36 of FIG. 35.

The projected portion 36*e* occupies, as shown in FIG. 36, 80% or more of the entire width of the body member 36 when the projected portion 36*e* is observed from the front side. In the present embodiment, the projected portion 36*e* is provided throughout the entire body member 36 in the width direction. Accordingly, the projected portion 36*e* occupies 100% of the entire width of the body member 36.

The projected portion 36*e* has a slope 36*e*1 which inclines so that the projection amount of the projected portion 36*e* increases towards the center with respect to the width direction of the body member 36, when the projected portion 36*e* is observed from the front. Accordingly, the projected portion 36*e* has a tapered shape. Further, the tip 36*e*2 of the projected portion 36*e* is curved so that the bottom 8 side is projected.

The bottom 37 is fixed to the bottom 8 of the container body 3. The end portion at the mouth portion 9 side of the bottom 37 has a shape which is complementary with the end portion at the bottom 8 side of the body member 36. The bottom 37 is not engaged with the body member 36. Accordingly, the end portion at the bottom 8 side of the body member 36 is not fixed, and can be easily deformed.

When used, a pressing force is applied to the projected portion 36*e* to eject the contents.

10. Other Embodiments

In the fifth and the sixth embodiment, the pair of first regions 61 are provided so as to face each other, however, the first region 61 can be provided at a single portion.

In the sixth and the eighth embodiment, the bottom can be omitted.

Instead of fixing the outer case 6 by clamping the outer case 6 with the cap 4*e* and the shoulder 10, the outer case 6 can be fixed to the container body 3 by another mechanism.

Instead of providing a plurality of regions made of different materials, the entirety of the outer case 6 can be formed with a soft material.

A different constitution can be used as the valve member 11, so long as it can close the outer-air introducing hole 15 when a pressing force is applied to the outer case 6, and can allow flow through the outer-air introducing hole 15 when the pressing force is removed.

The second region 62 can be formed with a non-resin material such as metal and ceramics.

In the eighth embodiment, the body member 36 and the bottom 37 can be engaged at the base portion 36*f*.

Instead of providing a built-in check valve to the cap 4*e*, an another member of a check valve can be disposed in between the cap 4*e* and the container body 3.

EXPLANATION OF SYMBOLS

1: delaminatable container, 2: outer case, 2*a*: body portion, 2*b*: bottom, 2*c*: reduced diameter portion, 2*d*: supporting portion, 2*e*: outer-air flow passage, 2*f*: male screw portion, 2*g*: radially enlarged portion, 2*h*: cutout portion, 2*i*: annular recessed portion, 3: container body, 3*a*: body portion, 3*b*: bottom, 3*c*: flanged portion, 3*c*1: annular portion, 3*c*2: projecting portion, 3*d*: mouth portion, 3*e*: male screw portion, 3*f*: upper surface, 4: pump, 4*a*: main body, 4*a*1: tubular portion, 4*a*2: cylinder, 4*a*3: upper wall, 4*a*4: female screw portion, 4*a*5: flanged portion, 4*b*: piston, 4*c*: nozzle, 4*d*: tube, 4*e*: cap, 5: fixing ring, 5*a*: outer tubular portion, 5*b*: upper wall, 5*c*: opening portion, 5*d*: inner tubular portion, 5*e*: outer-air flow passage, 5*f*: female screw portion, 5*g*: annular projected portion, 5*h*: outer-air introducing hole, 5*i*:

projecting portion, 5*j*: recessed portion, 5*k*: tubular portion, 5*l*: female screw portion, 6: outer case, 6*a*: body portion, 6*b*: upper wall, 6*c*: opening portion, 6*d*: opening portion, 7: containing portion, 7*a*: recessed portion, 8: bottom, 8*a*: seal portion, 9: mouth portion, 9*d*: engaging portion, 10: shoulder, 11: valve member, 11*a*: shaft, 11*b*: locking member, 11*c*: 11*d*, 11*d*: flow passage, 12: outer shell, 12*a*: clamping portion, 14: inner bag, 14*a*: inner bag exposed portion, 15: outer-air introducing hole, 16: body member, 16*a*: body portion, 16*a*1: panel portion, 16*b*: upper wall, 16*c*: opening portion, 16*d*: opening portion, 17: bottom, 17*a*: projecting portion, 18: body portion gap, 19: bottom gap, 21: intermediate space, 22: gap, 26: body constituent members, 26*f*: reduced diameter portion, 26*g*: projecting portion, 36: body member, 36*a*: body portion, 36*b*: upper wall, 36*c*: opening portion, 36*d*: opening portion, 36*e*: projected portion, 36*e*1: slope, 36*e*2: tip, 36*f*: base portion, 37: bottom, 61: first region, 62: second region, CP: central position, S: outer space, V1: volume

The invention claimed is:

1. A delaminatable container, comprising:

a container body; and a tubular outer case being installed on the container body; wherein the container body comprises an outer shell and an inner bag, and the inner bag shrinks as contents decrease, the outer case contains the container body therein, the container body comprises a body portion and a flanged portion which protrudes from the body portion in a radially outward direction, the flanged portion is supported by a supporting portion of the outer case, and a bottom surface of the flanged portion comes into contact with the supporting portion.

2. The delaminatable container of claim 1, wherein each of the container body and the outer case comprises a body portion; and a body portion gap is provided in between a body portion of the container body and a body portion of the outer case.

3. The delaminatable container of claim 1, wherein the flanged portion is hollow.

4. The delaminatable container of claim 1, wherein each of the container body and the outer case is provided with a bottom; and a bottom gap is provided in between the bottom of the container body and the bottom of the outer case.

5. The delaminatable container of claim 4, wherein the bottom of the container body is provided with an outer-air introducing hole which introduces outer-air in between the outer shell and the inner bag.

6. The delaminatable container of claim 1, wherein the contents are filled in the container body; and a gap is provided in between the inner bag and the outer shell in a condition after the contents are filled and before a user starts ejecting the contents.

7. The delaminatable container of claim 1, wherein the delaminatable container comprises a fixing ring; and the container body and the outer case are installed on the fixing ring.

8. The delaminatable container of claim 7, wherein the delaminatable container comprises a pump which ejects the contents; and the pump is installed on the fixing ring.

9. A delaminatable container, comprising:

a container body; and a tubular outer case being installed on the container body; wherein the container body comprises an outer shell and an inner bag, and the inner bag shrinks as contents decrease, wherein the outer case contains the container body therein;

wherein the container body comprises a body portion and a flanged portion which protrudes from the body portion in a radially outward direction and the flanged portion is supported by the outer case; and wherein an outer-air flow passage is provided in between the flanged portion and the outer case.

10. A delaminatable container, comprising:

a container body; and a tubular outer case being installed on the container body; wherein the container body comprises an outer shell and an inner bag, and the inner bag shrinks as contents decrease;

wherein the container body comprises a containing portion which contains contents, and a mouth portion which ejects the contents from the containing portion;

the outer case is installed so as to cover at least a portion of the containing portion; and the delaminatable container is constituted so as to be capable of ejecting the contents from the mouth portion by deforming the outer case;

wherein the outer case comprises a body member; and the body member is constituted by combining a pair of body constituent members.

11. The delaminatable container of claim 10, wherein the outer case is constituted so as to restore an original shape of the outer case by a restoring ability of the outer case when a pressing force is removed after the outer case is deformed by applying the pressing force to the outer case.

12. The delaminatable container of claim 10, wherein the outer case is an injection molded body.

13. The delaminatable container of claim 10, wherein the outer case comprises a first region and a second region; and the first region is formed with a material having a lower bending elastic modulus than a bending elastic modulus of a material structuring the second region; or the first region is thinner than the second region.

14. The delaminatable container of claim 10, wherein the outer case is installed so as to cover the container body from the mouth portion side of the container body.

15. The delaminatable container of claim 10, further comprising a cap installed on the mouth portion; wherein the outer case is clamped and fixed by the cap and the container body.

* * * * *